US008244153B2

(12) United States Patent
Nakashima

(10) Patent No.: US 8,244,153 B2
(45) Date of Patent: Aug. 14, 2012

(54) FRAME STRUCTURE FOR AN IMAGE FORMING APPARATUS

(75) Inventor: Atsuhisa Nakashima, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 414 days.

(21) Appl. No.: 12/563,959

(22) Filed: Sep. 21, 2009

(65) Prior Publication Data

US 2010/0080612 A1 Apr. 1, 2010

(30) Foreign Application Priority Data

Sep. 26, 2008 (JP) ..... 2008-248597

(51) Int. Cl.
*G03G 21/18* (2006.01)

(52) U.S. Cl. ..... 399/107; 399/111

(58) Field of Classification Search ..... 399/107, 399/110, 111

See application file for complete search history.

(56) References Cited

U.S. PATENT DOCUMENTS

| | | | | |
|---|---|---|---|---|
| 8,056,894 | B2 * | 11/2011 | Ichikawa | 271/10.01 |
| 2007/0160382 | A1 | 7/2007 | Tomatsu | |
| 2008/0003015 | A1 | 1/2008 | Tomatsu | |
| 2008/0012771 | A1 | 1/2008 | Watanabe | |

FOREIGN PATENT DOCUMENTS

| | | | |
|---|---|---|---|
| JP | H01-169466 | A | 7/1989 |
| JP | 2001-296494 | A | 10/2001 |
| JP | 2002-258560 | A | 9/2002 |
| JP | 2005-077637 | A | 3/2005 |
| JP | 2007-148142 | A | 6/2007 |
| JP | 2008-009260 | A | 1/2008 |
| JP | 2008-009293 | A | 1/2008 |

OTHER PUBLICATIONS

Japan Patent Office, Notification of Reasons for Rejection for Japanese Patent Application No. 2008-248597, dispatched Jul. 27, 2010.

* cited by examiner

*Primary Examiner* — Walter L Lindsay, Jr.
*Assistant Examiner* — Ruth Labombard
(74) *Attorney, Agent, or Firm* — Baker Botts L.L.P.

(57) ABSTRACT

The image forming apparatus includes detachable unit components and a frame assembly to hold the detachable unit components in predetermined positions in the image forming apparatus. The frame assembly includes a pair of metal frames and a pair of resin frames, each of which is attached to one of the metal frames. Each of the metal frames includes a first positioning structure, which corresponds to an original point of the metal frame, a first fixing structure, a second positioning structure, wherein each of the resin frames includes a first positioning structure, which corresponds to an original point of the resin frame; a fixing structure; a second positioning structure; and a plurality of pressing pieces, by which the resin frame is pressed against one of the metal frame.

17 Claims, 18 Drawing Sheets

FRAME STRUCTURE FOR AN IMAGE FORMING APPARATUS

CROSS REFERENCE TO RELATED APPLICATION

This application claims priority from Japanese Patent Application No. 2008-248597, filed on Sep. 26, 2008,the entire subject matter of which is incorporated herein by reference.

BACKGROUND

1. Technical Field

An aspect of the present invention relates to an image forming apparatus having a removable unit component such as a belt unit.

2. Related Art

When detachable unit components of an image forming apparatus such as a belt unit are installed in the image forming apparatus, the unit components are often held by a frame structure of the image forming apparatus, which is, for example, disclosed in United States Patent Application Publication No. 2008/0003015 A1. According to the disclosure, the frame structure includes a pair of metal frames with enhanced intensity and a pair of resin frames attached to the metal frames. The unit components are placed in the frame structure, specifically in positions defined by positioning structures, such as projections and slots, formed in the resin frames.

SUMMARY

The image forming apparatus includes a plurality of detachable unit components and a frame assembly to hold the detachable unit components in predetermined positions in the image forming apparatus. The frame assembly includes a pair of metal frames and a pair of resin frames, each of which is attached to one of the metal frames. Each of the metal frames includes a first positioning structure, which corresponds to an original point of the metal frame, a first fixing structure, a second positioning structure. Each of the resin frames includes a first positioning structure, which corresponds to an original point of the resin frame, a fixing structure, a second positioning structure, a plurality of pressing pieces, by which the resin frame is pressed against one of the metal frame. Each of the resin frames is set in a predetermined position with respect to one of the metal frames by having the first positioning structure of the resin frame to coincide with the first positioning structure of the metal frame so that the original point of the resin frame coincides with the original point of the metal frame. Each of the resin frames is fixed to one of the metal frame by having the fixing structure of the resin frame fixed to the fixing structure of the metal frame. Each of the resin frames is restricted from moving in a specific direction and allowed to move in a different direction with respect to one of the metal frames by having the second positioning structure of the resin frame to coincide with the second positioning structure of the metal frame. A first length between the coinciding first positioning structures of the resin frame and the metal frame and the coinciding fixing structures of the resin frame and the metal frame is smaller than a second length between the coinciding first positioning structures of the resin frame and the metal frame and the coinciding second positioning structures of the resin frame and the metal frame. The plurality of pressing pieces are provided in positions outside closer to outer edges of the resin frame with respect to the first positioning structure and the fixing structure of the resin frame.

According to the above configuration, when the resin frame thermally expands or contracts with respect to the metal frame, areas in the resin frame excluding the first positioning structure tend to move with respect to the metal frame. Meanwhile, the resin frame is allowed to move in the direction different from the specific direction, and the resin frame is pressed against the metal frame at the pressing pieces presses, which are not fixed to the metal frame. Therefore, the resin frame is movable with respect to the metal frame at the pressing pieces. Further, the resin frame is fixed to the metal frame at the fixing structure; therefore, when the resin frame tends to expand or contract with respect to the metal frame, the resin frame tends to be distorted at an area including the first length.

However, according to the above configuration, with the first length being smaller than the second length, an amount of the thermal distortion in the area including the first length can be reduced.

On the other hand, when the first length is smaller than the second length, substantial holding force to hold the resin frame on the metal frame may not be achieved; however, according to the above configuration, the pressing pieces are provided in positions outside closer to outer edges of the resin frame with respect to the first positioning structure and the fixing structure of the resin frame. Therefore, substantial distances between the respective pressing pieces and the first positioning structure can be secured so that the resin frame is attached to the metal frame with the substantial holding force without having the pressure to press the resin frame against the metal frame to be greater.

Thus, according to the above configuration, the resin frames can be attached to the metal frames with substantial holding force whilst prevented from experiencing a large amount of thermal distortion so that the resin frames are prevented from being exhausted earlier.

According to another aspect of the present invention, an image forming apparatus is provided. The image forming apparatus includes a plurality of detachable image forming units aligned in line along a direction, and a detachable belt unit, which is arranged to oppose the image forming units and includes a belt and belt frames. The belt has a surface to extend along the direction of the alignment of the image forming units and is movable in the direction. The belt frames hold the belt at each widthwise end of the belt. The widthwise ends of the belt are parallel to the moving direction of the belt. The image forming apparatus further includes a frame assembly configured to hold the image forming units and the belt unit therein. The frame assembly includes a pair of side frames, each of which is disposed to oppose to the other on each widthwise side of the belt unit and has a plane to extend perpendicularly to the surface of the belt and in parallel with the moving direction of the belt, and a plurality of connecting frames, which connect the opposing side frames. Each of the side frames includes a plate-like metal frame and a pair of plate-like resin frames. The pair of resin frames are arranged to oppose to each other to hold the image forming units and the belt unit therebetween and are attached to the metal frames respectively to cover at least partially inner surfaces of the metal frames. Each of the connecting frames is fixed to the inner surfaces of the metal frames at each end thereof. The belt unit is detachably held by the opposing resin frames in a predetermined position in the opposing direction of the image forming units and the belt unit.

According to the above configuration, the connecting frames are fixed to the metal frames at each end thereof; therefore, the metal frames are likely to be maintained in correct positions and in correct postures within the frame assembly. Further, the resin frames are fixed to the inner surfaces of the metal frames. Because resin has better plasticity than metals, forming the resin frames to have the structures to hold the belt unit is easier than forming the metal frames. Thus, the resin frames having better plasticity are fixed to the inner surfaces of the metal frames to hold the belt unit. Accordingly, the belt frame is held in a correct position by the resin frames which are fixed to the metal frames while the metal frames are securely held within the frame assembly by the connecting frames.

BRIEF DESCRIPTION OF THE ACCOMPANYING DRAWINGS

DETAILED DESCRIPTION

Hereinafter, an embodiment according to an aspect of the present invention will be described with reference to the accompanying drawings.

Figure 1:
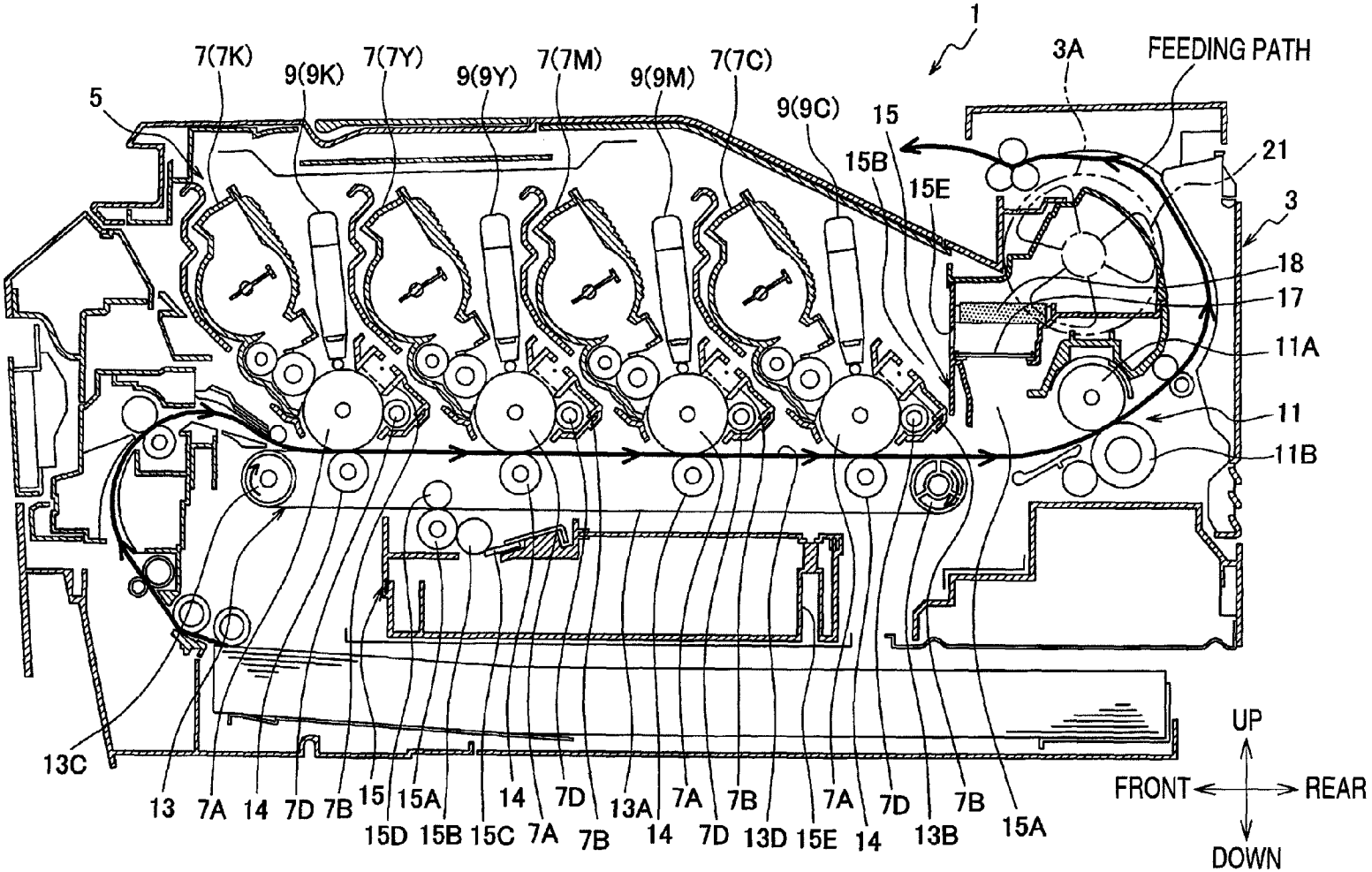
FIG. 1 is a cross-sectional side view of a printer according to an embodiment of the present invention.

FIG. 1 is a cross-sectional side view of a printer 1 as an example of an image forming apparatus according to an embodiment of the present invention. In the present embodiment, directions concerning the printer 1 will be referred to based on the orientation of the printer 1 shown in FIG. 1. A right-left direction of the printer 1 refers to a direction perpendicular to the cross-section of the printer 1 in FIG. 1, and is also referred to as a widthwise direction. The printer 1 includes a chassis 3, in which an image forming unit 5 is stored. An up-down direction in FIG. 1 may also be referred to as a vertical direction. A recording sheet (e.g., paper and an OHP sheet) is fed in the image forming unit 5 and processed to have an image formed in a developer agent transferred on a surface thereof. The image forming unit 5 includes processing cartridges 7, exposure units 9, and fixing unit 11.

Figure 2:
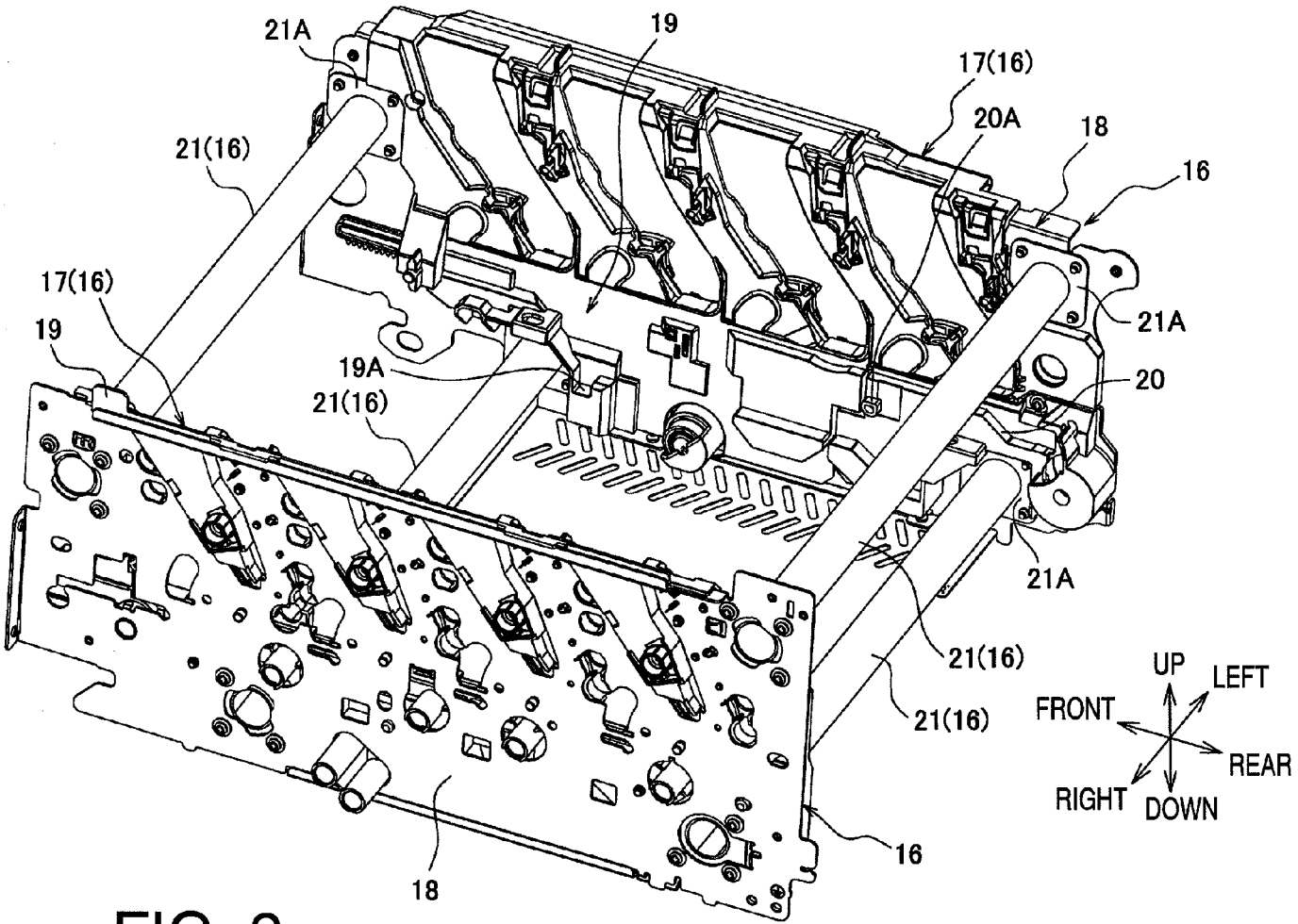
FIG. 2 is a perspective view of a frame assembly of the printer according to the embodiment of the present invention.

The printer 1 is a direct-tandem color LED printer with a casing 2, in which four processing cartridges 7 are arranged in line in a front-rear direction. The processing cartridges 7 include a processing cartridge 7K for black, a processing cartridge 7Y for yellow, a processing cartridge 7M for magenta, and a processing cartridge 7C for cyan. The processing cartridges 7K, 7Y, 7M, 7C are detachably installed in the frame assembly 16 (see FIG. 2), which supports the printer 1.

Each of the processing cartridges 7K, 7Y, 7M, 7C is provided with a different colored developer agent, and other than the colors of the developer agents, the processing cartridges 7K, 7Y, 7M, 7C have substantially same structures and functions. In particular, each of the processing cartridges 7K, 7Y, 7M, 7C includes a photosensitive drum 7A to carry the developer agent, a charger 7B to charge a surface of the photosensitive drum 7A, and a cleaner 7D to clean the surface of the photosensitive drum 7A which underwent transfer of the developer-formed image to the recording sheet.

The photosensitive drums 7A of the processing cartridges 7K, 7Y, 7M, 7C are thus arranged in positions to oppose a tensioned surface 13D of a transfer belt 13A, which will be described later in detail, in line along a rolling direction of the transfer belt 13A. The exposure units 9 include exposure units 9K, 9Y, 9M, 9C, which are arranged to correspond to the processing cartridges 7K, 7Y, 7M, 7C respectively. Each of the exposure units 9K, 9Y, 9M, 9C includes a plurality of LEDs (not shown) aligned in line being parallel to an axial direction of the photosensitive drum 7A. The LEDs are controlled to be switched on and off so that the photoconductive drum 7A is exposed to the light emitted from the LEDs.

The photosensitive drum 7A is charged by the charger 7B and exposed to the beams of the exposure unit 9 that scans the surface of the photosensitive drum 7A according to image data, which represents an image to be formed on the recording sheet. Thus, a latent image is formed on the surface of the photosensitive drum 7A. When electrically charged developer agent is supplied to the photosensitive drum 7A with the latent image, the developer agent adheres to regions corresponding to the latent image, and latent image appears to be an image formed in the developer agent.

The image forming unit 5 further includes transfer rollers 14, which are arranged in positions to oppose the photosensitive drums 7A respectively with the transfer belt 13A intervening between the transfer rollers 14 and the photosensitive drums 7A. The transfer rollers 14 are thus respectively pressed to the photosensitive drums 7A through the transfer belt 13A. The recording sheet is fed between the photosensitive drums 7A and the transfer belt 13A to have the developer-formed image transferred onto the surface thereof.

After having the developer-formed image transferred onto the surface thereof, the recording sheet is carried to the fixing unit 11. The fixing unit 11 includes a heat roller 11A with a heat source (not shown) and a pressure roller 11B, which are arranged in parallel to oppose each other. The pressure roller 11B is pressed to be in contact with the heat roller 11A. The developer agent forming the image on the surface of the recording sheet is thermally fixed thereto when the recording sheet is fed between the heat roller 11A and the pressure roller 11B.

Figure 3:
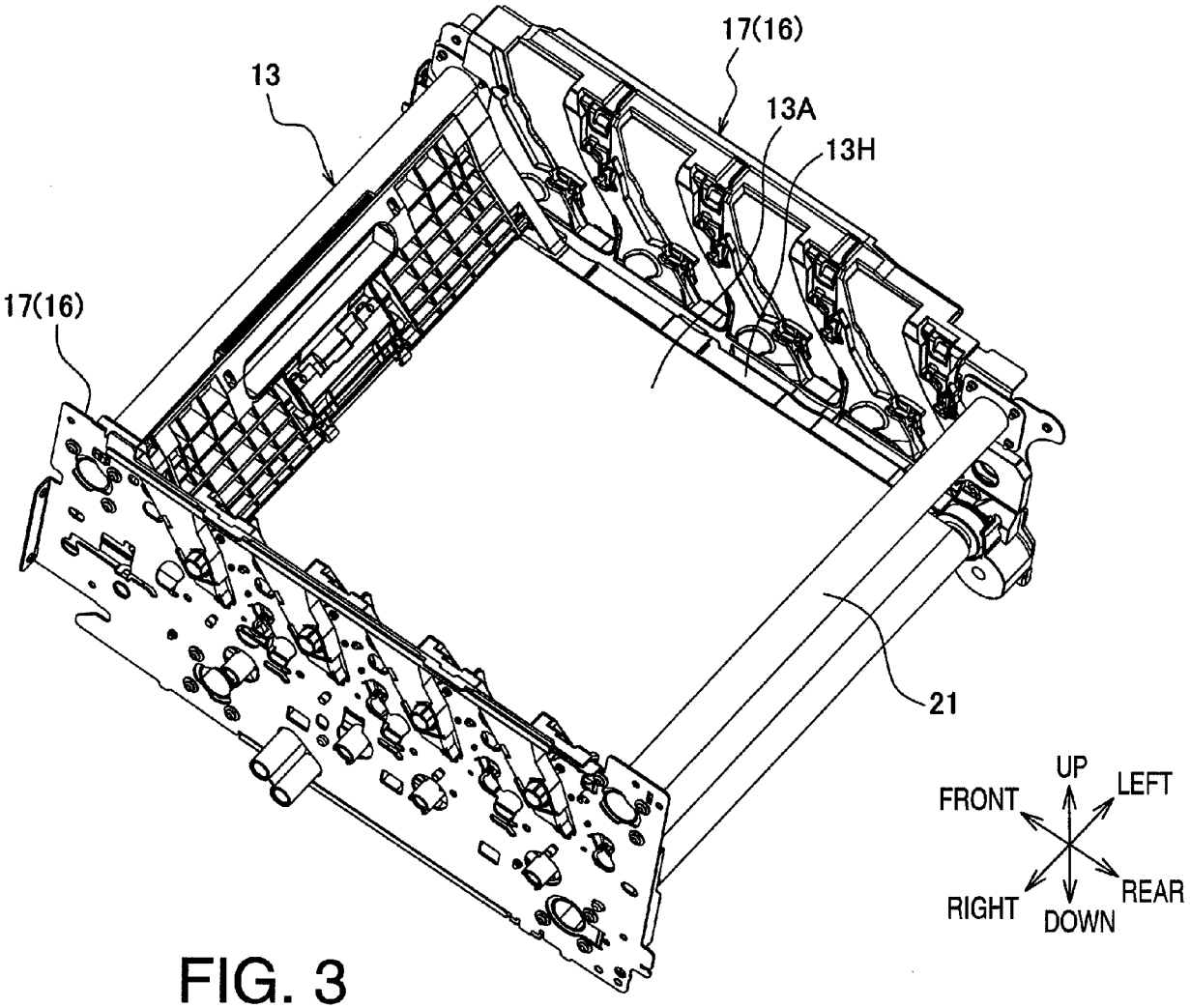
FIG. 3 is a perspective view of the frame assembly of the printer with a belt unit installed therein according to the embodiment of the present invention.
Figure 4:
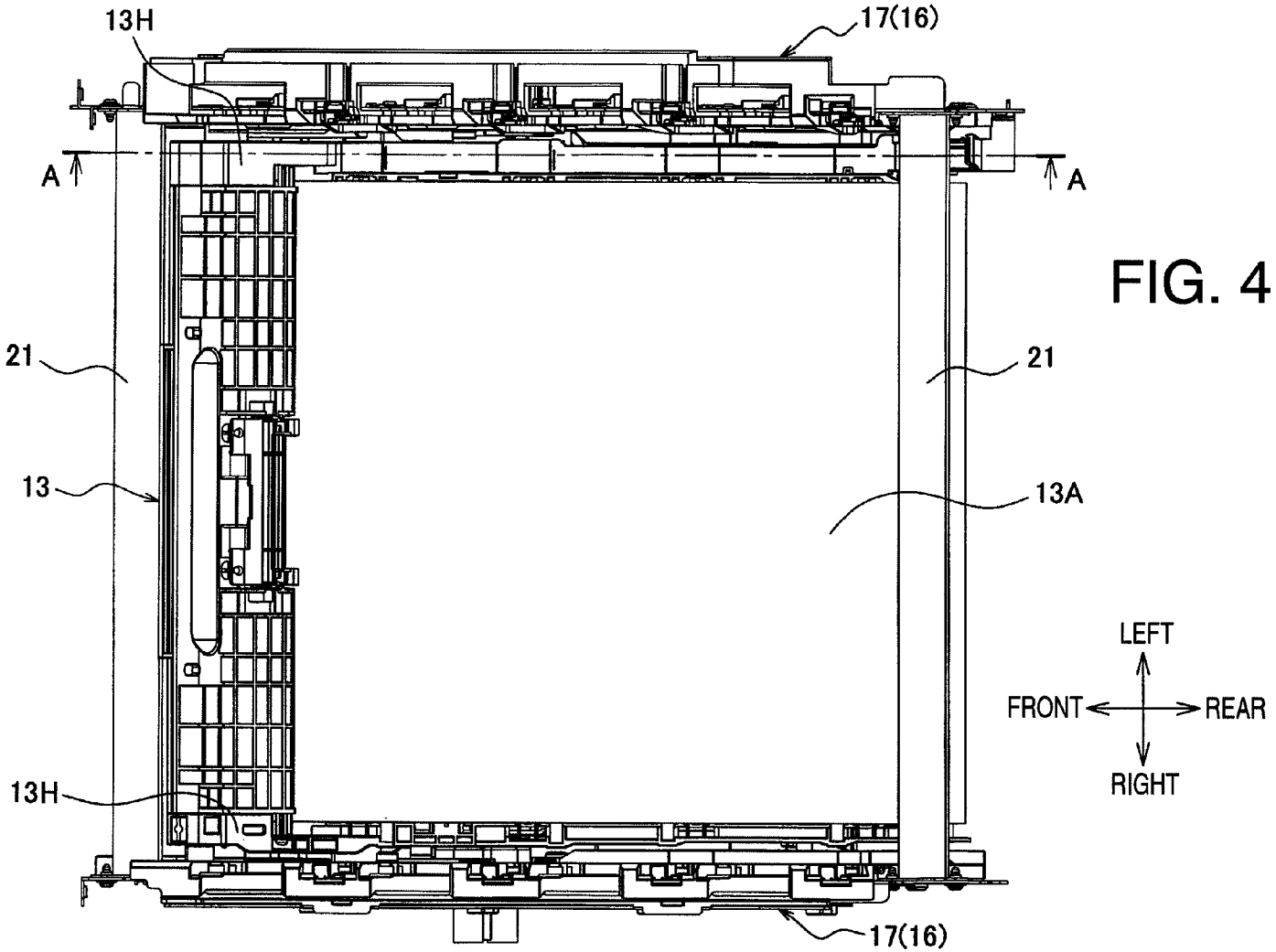
FIG. 4 is a top view of the frame assembly of the printer with the belt unit installed therein according to the embodiment of the present invention.

The printer 1 is further provided with a belt unit 13, which includes the transfer belt 13A, a driving roller 13B, a driven roller 13C, and a pair of frames 13H (see FIGS. 3 and 4) which hold the driving roller 13B and the driven roller 13C. The belt unit 13 is detachably installed in the frame assembly 16.

The transfer belt 13A is an endless belt made of a resin (e.g., thermoplastic elastomer). The transfer belt 13A is arranged to roll around the driving roller 13A and the driven roller 13B. The driving roller 13B is rotated by a driving source (e.g., a motor), and the transfer belt 13A is rolled by the rotation of the driving roller 13B accordingly. The driven roller 13C is rotated by the rotation of the driving roller 13B and the rolling movement of the transfer belt 13A.

Figure 5:
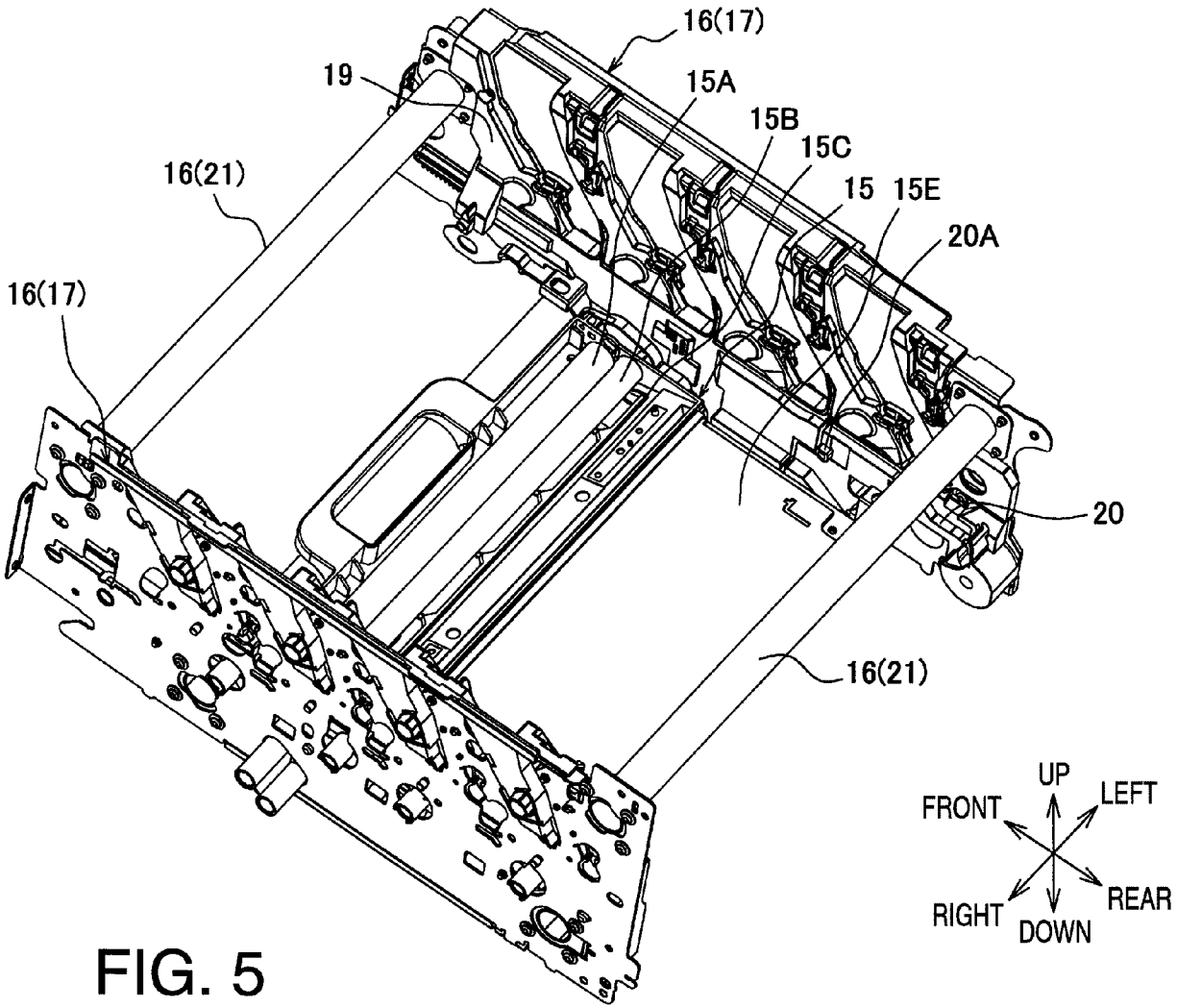
FIG. 5 is a perspective view of the frame assembly of the printer without the belt unit according to the embodiment of the present invention.

The printer 1 is further provided with a belt cleaner unit 15, which removes residues such as remaining developer agent from the surface of the transfer belt 13A. The belt cleaner unit 15 is arranged below the belt unit 13. The belt cleaner unit 15 is detachably installed in the frame assembly 16 (see FIG. 5).

The belt cleaner unit 15 includes a cleaning roller 15A, a cleaning shaft 15B, a scraper 15C, a backup roller 15D, and a residue container 15E. The developer agent and other residues remaining on the surface of the transfer belt 13A are removed therefrom by the cleaning roller 15A. Further, the developer agent adhered on the surface of the cleaning roller 15A is removed therefrom by electrostatic attraction of the cleaning shaft 15B and transferred to the surface of the cleaning shaft 15B. Thereafter, the developer agent is scraped off from the cleaning shaft 15B by the scraper 15C and is collected in the residue container 15E.

Next, the frame assembly 16 of the printer 1 will be described. The frame assembly 16 is a frame structure to hold the processing cartridges 7, the belt unit 13, and the belt cleaner unit 15 in the printer 1. The frame assembly 16 includes a pair of plate-like side frames 17, which are arranged on each side of the widthwise end of the frame assembly 16, and linear connecting frames 21, which extend in parallel with one another in the right-left direction to connect and hold the side frames 17.

Each connecting frame 21 is provided with a flange portion 21A on each end thereof. The flange portion 21A is arranged to become in contact with a part of the inner surface of the metal frame, thus the connecting frame 21 is fixed to a pair of metal frames 18 by, for example, screws and rivets inserted through holes (not shown) formed in the flange portion 21A. Each side frame 17 includes a metal frame 18, which improves rigidity of the frame assembly 16, a first resin frame 19, and a second resin frame 20. The metal frame 18 may be, for example, a cold-rolled steel plate such as SPCC steel. The first resin frame 19 and the second resin frame 20 are attached to the metal frame 18 and may be made of thermoplastic resin such as ABS.

Figure 6:
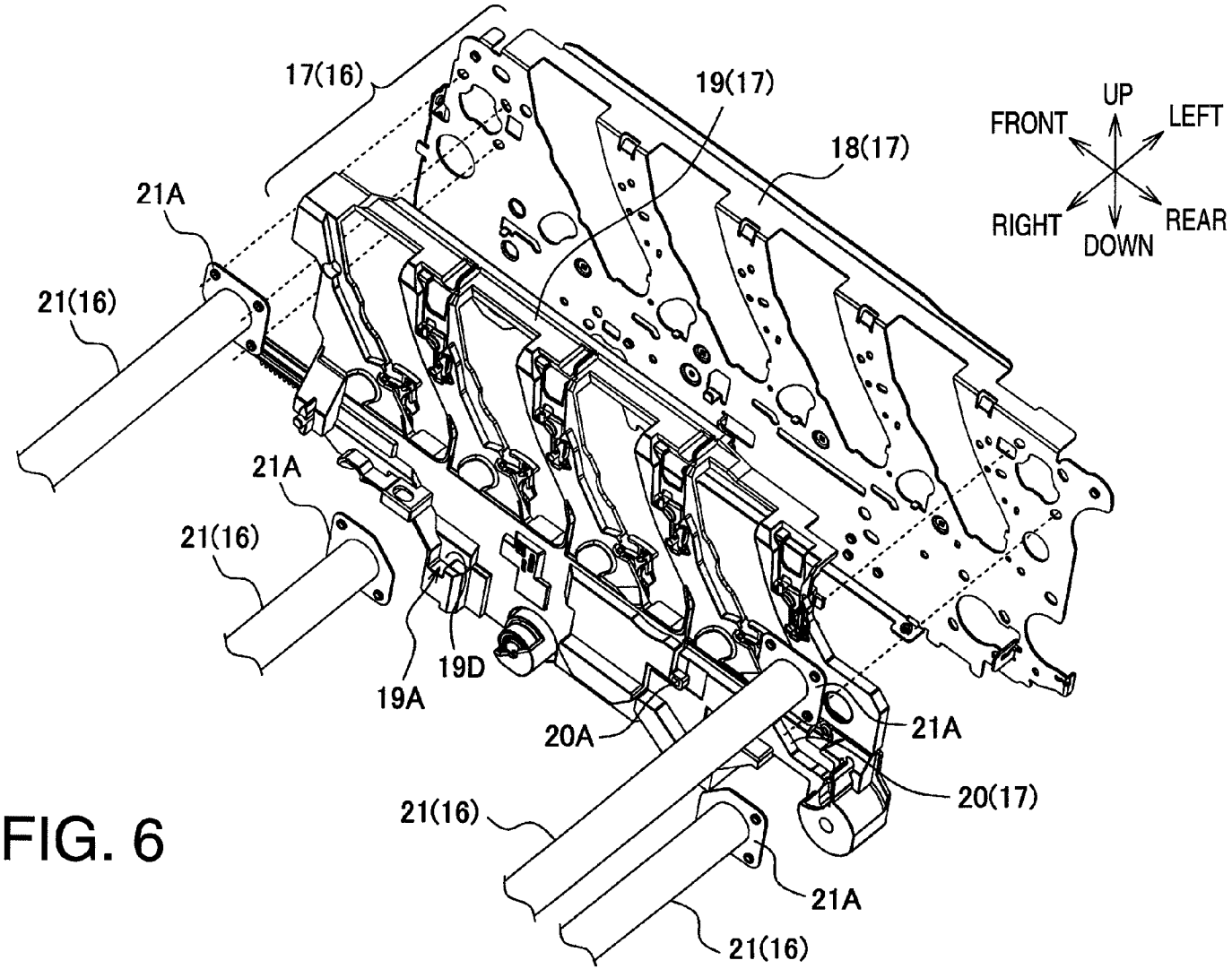
FIG. 6 is an exploded partial view of the frame assembly of the printer according to the embodiment of the present invention.
Figure 7:
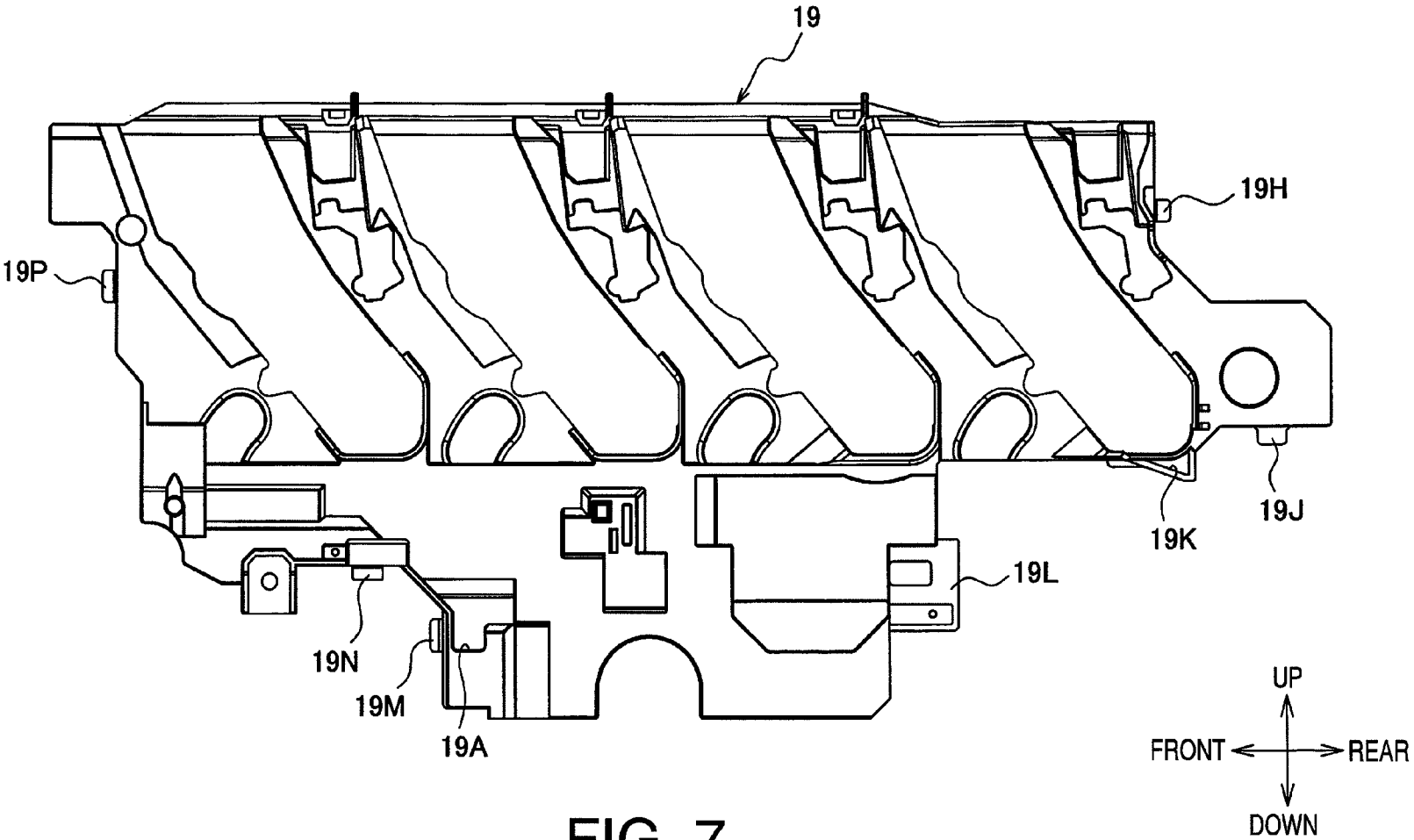
FIG. 7 is an inner side view of a first resin frame of the printer according to the embodiment of the present invention.
Figure 8:
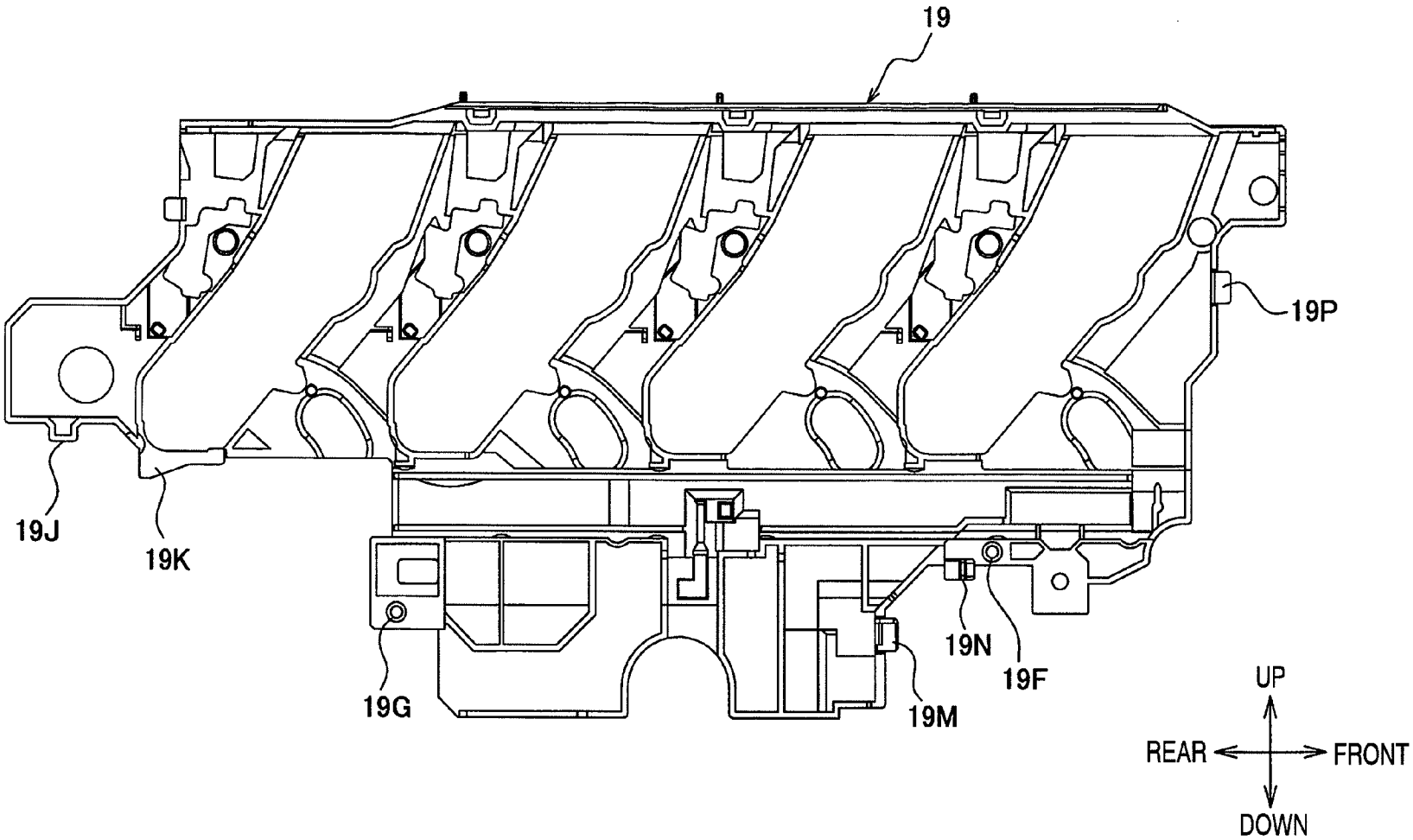
FIG. 8 is an outer side view of the first resin frame of the printer according to the embodiment of the present invention.
Figure 10:
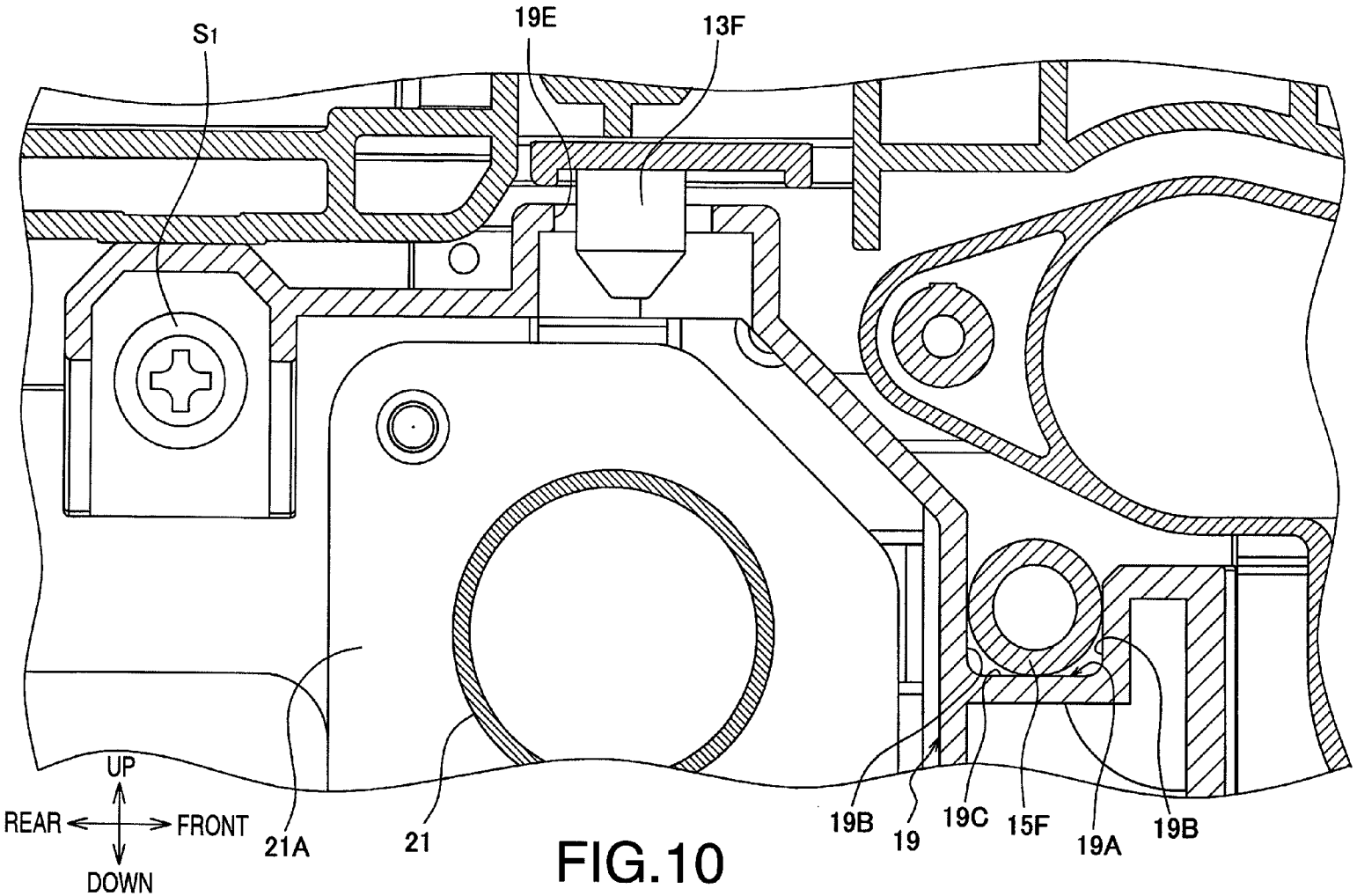
FIG. 10 is an enlarged view of an encircled portion A indicated in FIG. 9.

As shown in FIG. 7, each first resin frame 19 is formed to have a cleaner positioning portion 19A, which is a downwardly-formed recess, and by which the belt cleaner unit 15 is set in a correct position in the frame assembly 16. Meanwhile, the belt cleaner unit 15 is formed to have a cylindrical projection 15F (see FIG. 10), which is disposed in the recess of the cleaner positioning portion 19A when the belt cleaner unit 15 is installed in the frame assembly 16. When an outer diameter of the projection 15F becomes in contact with side surfaces 19B and a bottom surface 19C of the cleaner positioning portion 19A, the belt cleaner unit 15 is settled in a correct position with respect to the first resin frames 19. The side surfaces 19B of the cleaner positioning portion 19A define the position of the belt cleaner unit 15 in the front-rear direction, and the bottom surfaces 19C define the position of the belt cleaner unit 15 in a vertical direction. Further, lateral surfaces 19D (see FIG. 6) of the cleaner positioning portion 19A define the position of the belt cleaner unit 15 in the right-left (widthwise) direction.

Figure 9:
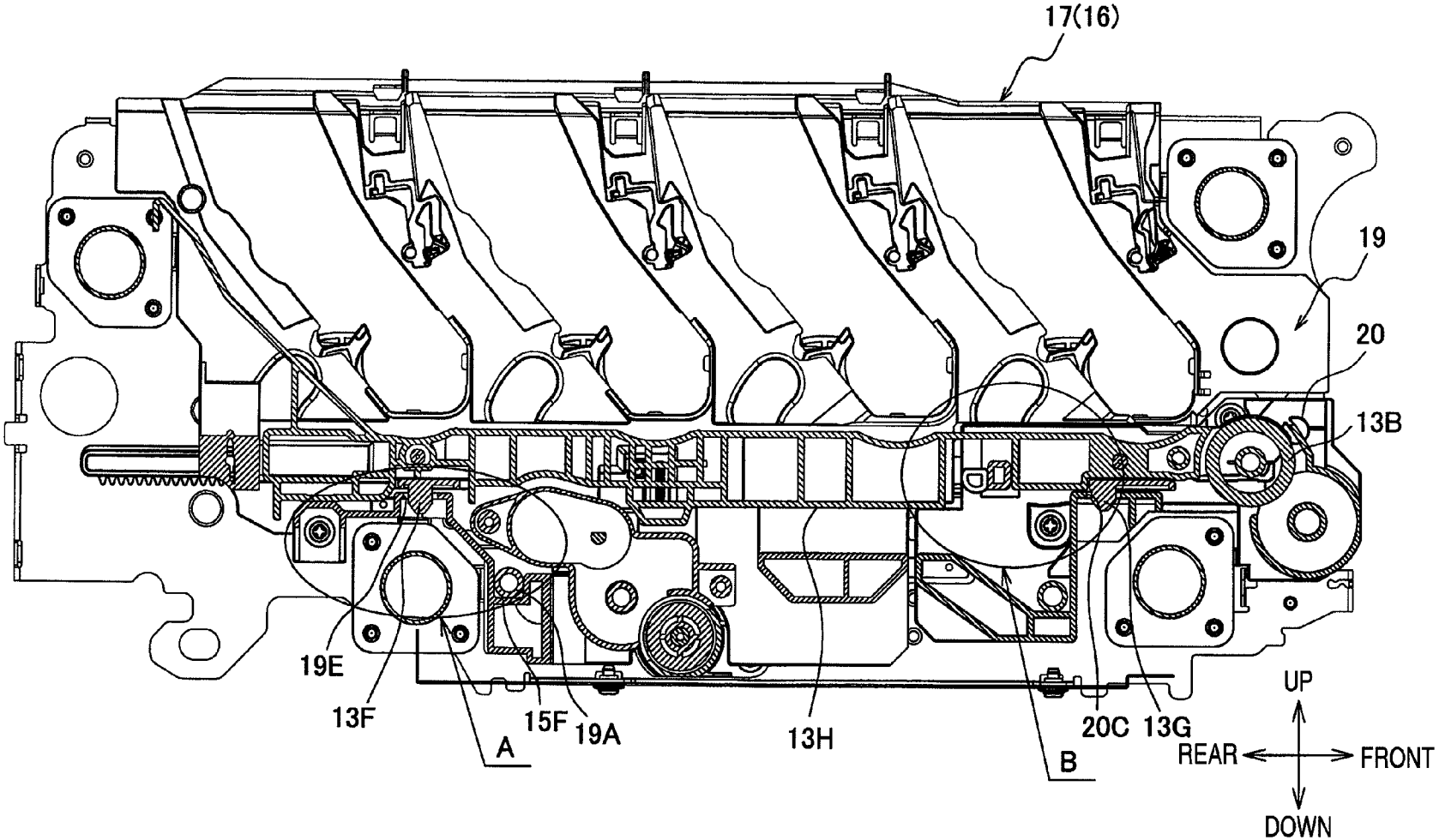
FIG. 9 is a cross-sectional side view of the frame assembly taken at a line A-A indicated in FIG. 4.
Figure 11:
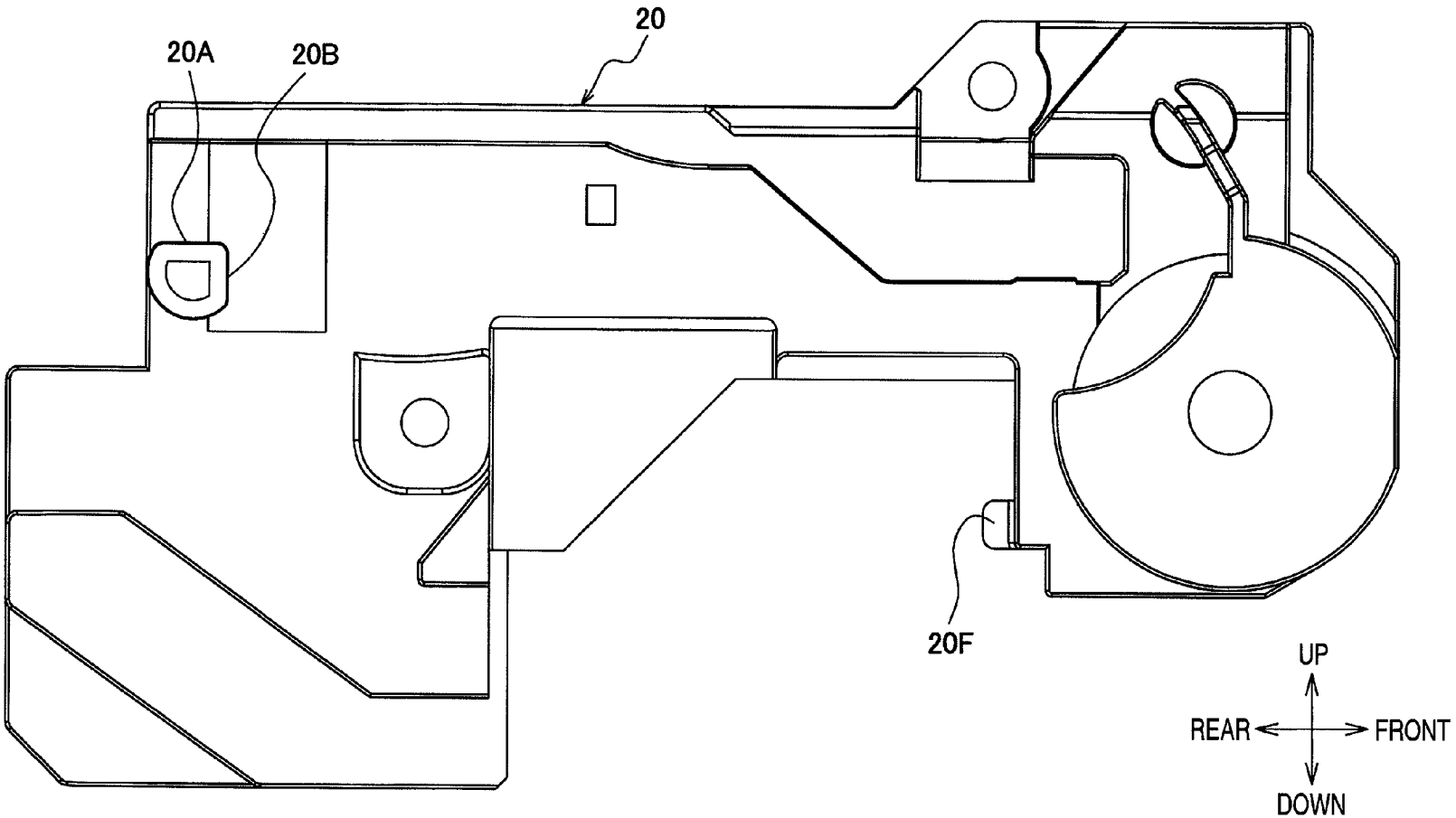
FIG. 11 is an inner side view of a second resin frame of the printer according to the embodiment of the present invention.
Figure 12:
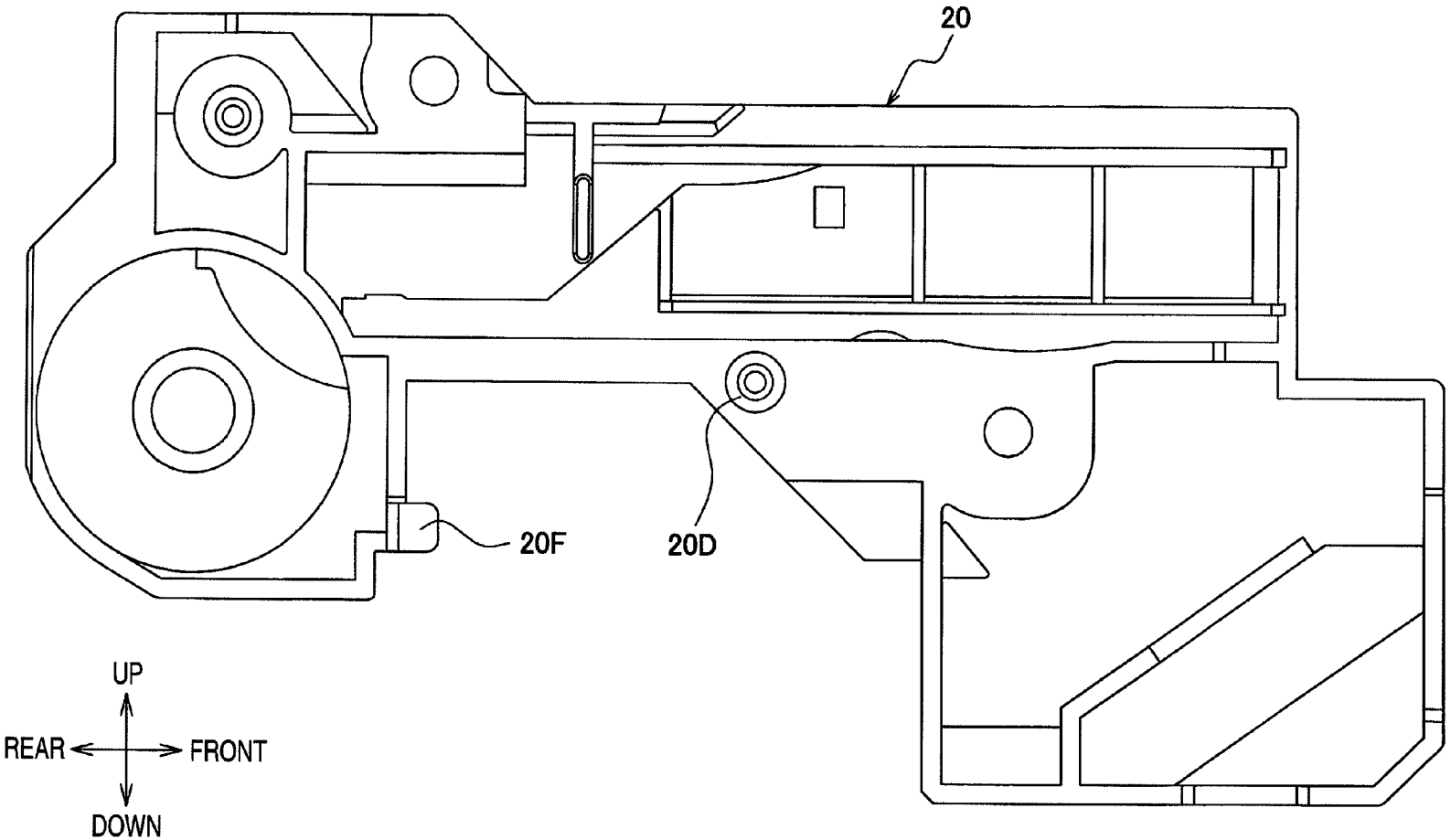
FIG. 12 is an outer side view of the second resin frame of the printer according to the embodiment of the present invention.
Figure 13:
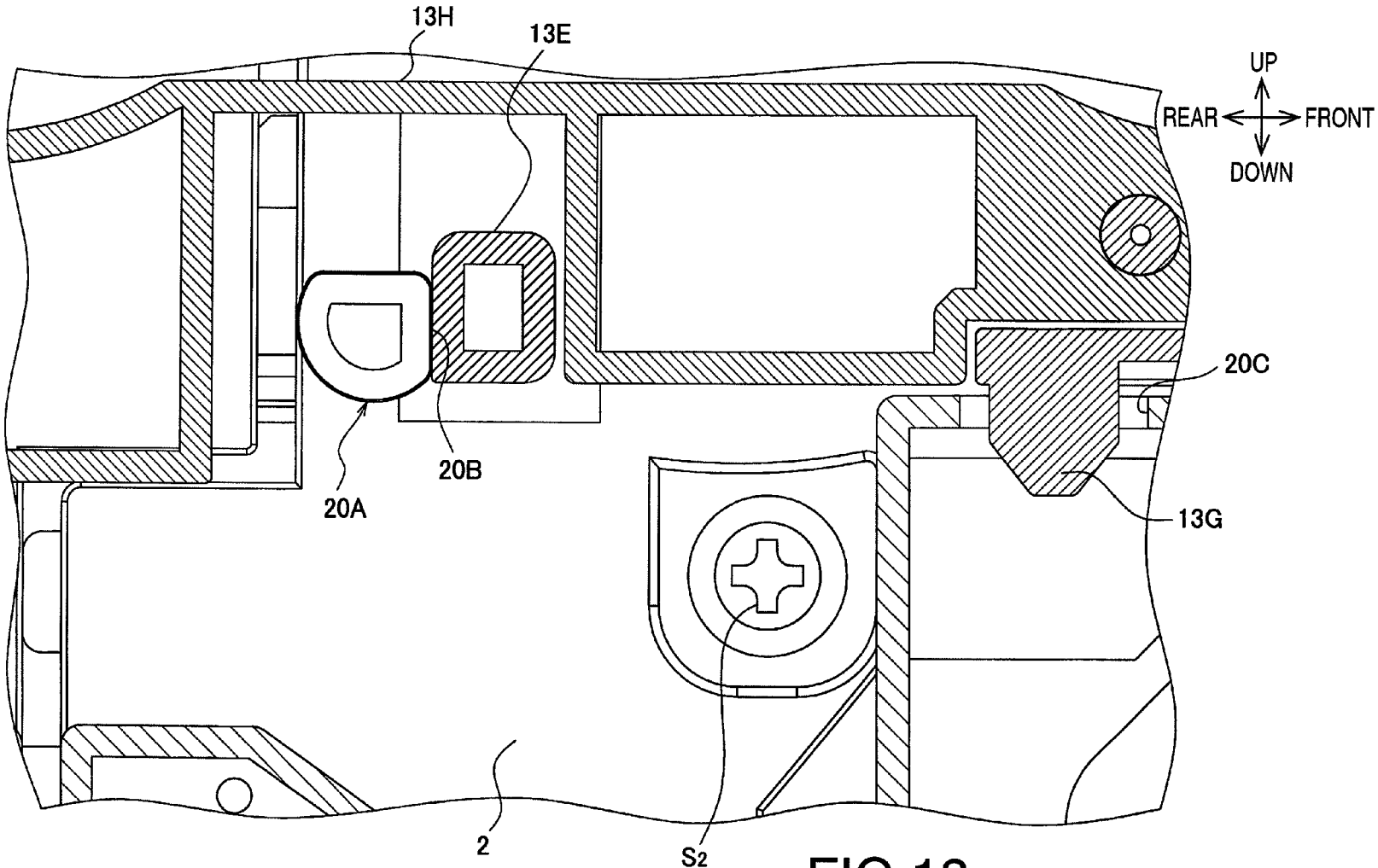
FIG. 13 is an enlarged view of an encircled portion B indicated in FIG. 9.

As shown in FIG. 11, each second resin frame 20 is formed to have a belt unit positioning portion 20A, by which the belt unit 13 is set in a correct position in the frame assembly 16. The belt unit positioning portion 20A is a projection to protrude in the right-left direction and has a reference surface 20B, which is substantially perpendicular to the rolling direction of the transfer belt 13A (i.e., perpendicular to the tensioned surface 13D). Meanwhile, each frame 13H of the belt unit 13 is formed to have a rectangular-column like projection 13E, which protrudes outward in the right-left direction of the belt unit 13. When a rear surface of the projection 13E becomes in contact with the reference surface 20B of the second resin frame 20, the belt unit 13 is restricted from being moved further to the rear of the printer 1, and the belt unit 13 is set in a correct position in the front-rear direction with respect to the second resin frames 20. The belt unit 13 is further formed to have projections 13F, 13G (see FIG. 9). The position of the belt unit 13 with respect to the frame assembly 16 in the right-left direction and in the vertical direction are defined by the projections 13F, 13G, which are received in holes 19E and 20C. The holes 19E and 20C are formed in the first resin frames 19 and the second resin frames 20 respectively.

Figure 16:
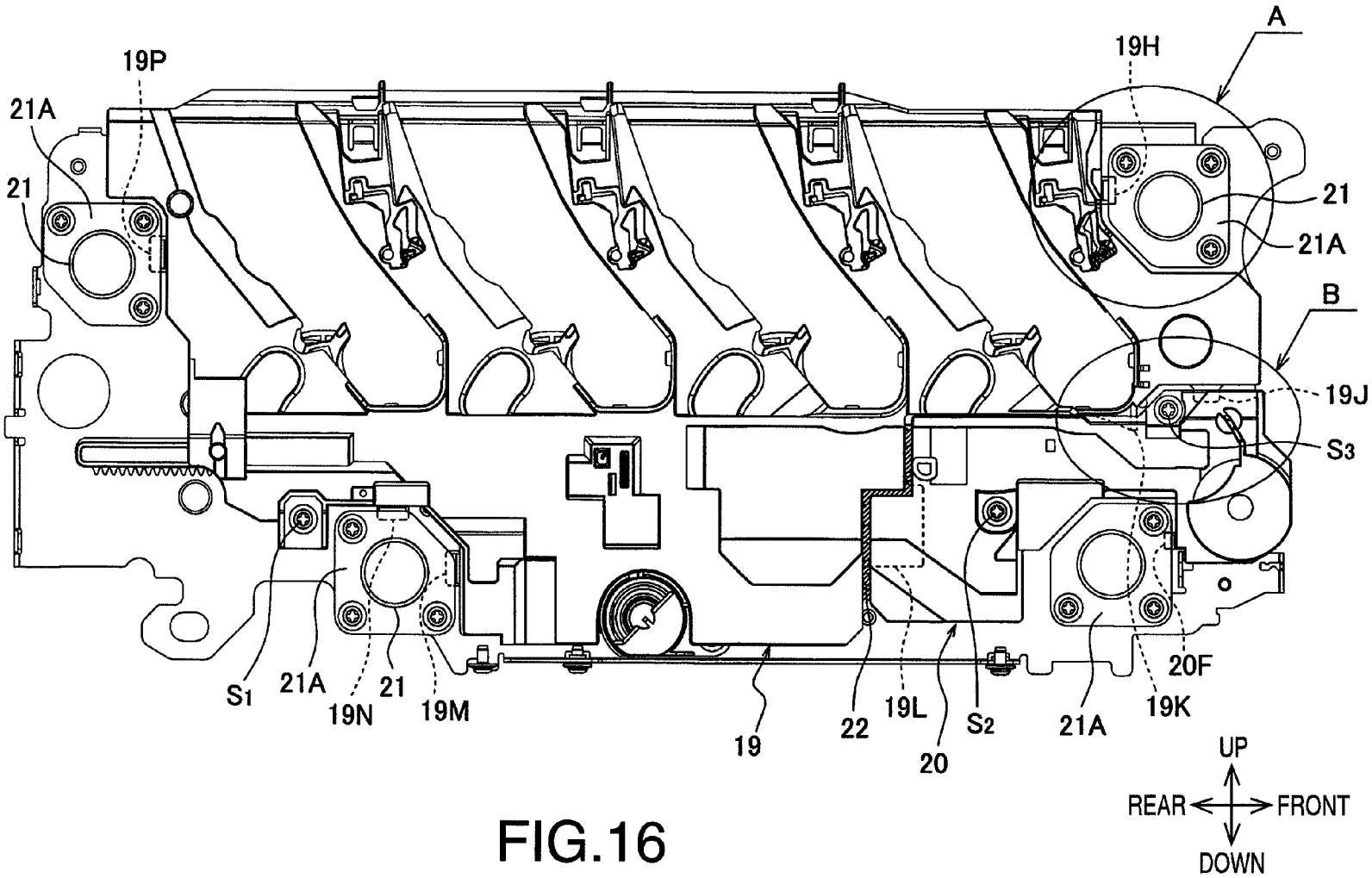
FIG. 16 is an inner side view of a side frame of the printer according to the embodiment of the present invention.

As shown in FIG. 16, each second resin frame 20 is arranged in the frame assembly 16 to be in the vicinity of the first resin frame 19 but to have a predetermined clearance 22, which is indicated by shading in FIG. 16, to be apart from the first resin frame 19 in the front-rear direction of the printer 1.

Figure 14:
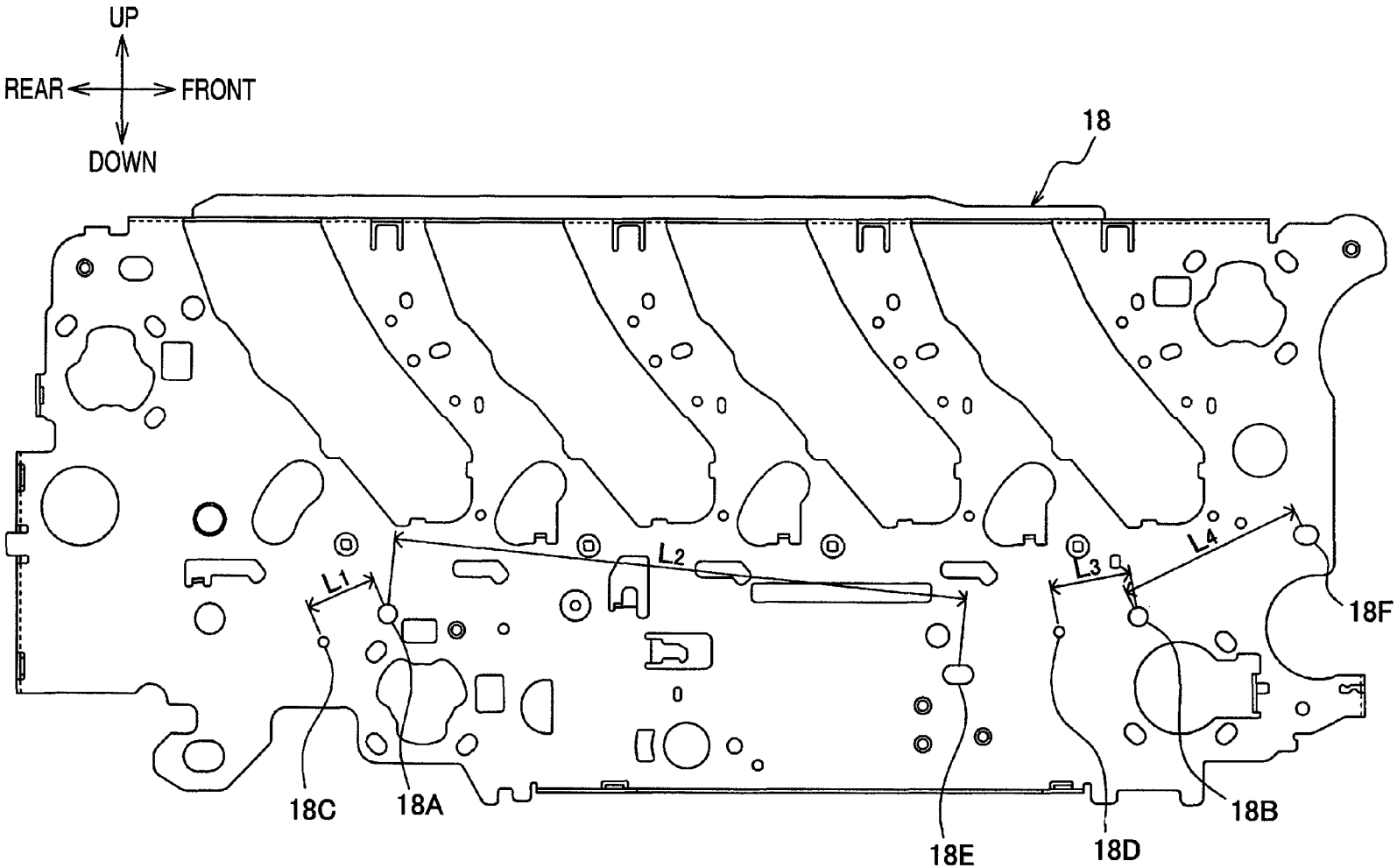
FIG. 14 is an inner side view of a metal frame of the printer according to the embodiment of the present invention.

As shown in FIG. 14, each metal frame 18 is formed to have a plurality of screw holes, by which the first resin frames 19 and the second resin frames 20 are fixed to the metal frames 18 in correct positions. The screw holes include first positioning holes 18A, 18B, fixing female screw holes 18C, 18D, and second positioning holes 18E, 18F. The first positioning holes 18A, 18B, the fixing female screw holes 18C, 18D, and the second positioning holes 18E, 18F are press-formed when the metal frames 18 are formed. When the fixing female screw holes 18C, 18D are press-formed, however, threads are incapable of being tapped by the pressing formation. Therefore, tapping screws (not shown) are screwed in the fixing female screw holes 18C, 18D to form the threads.

Figure 15:
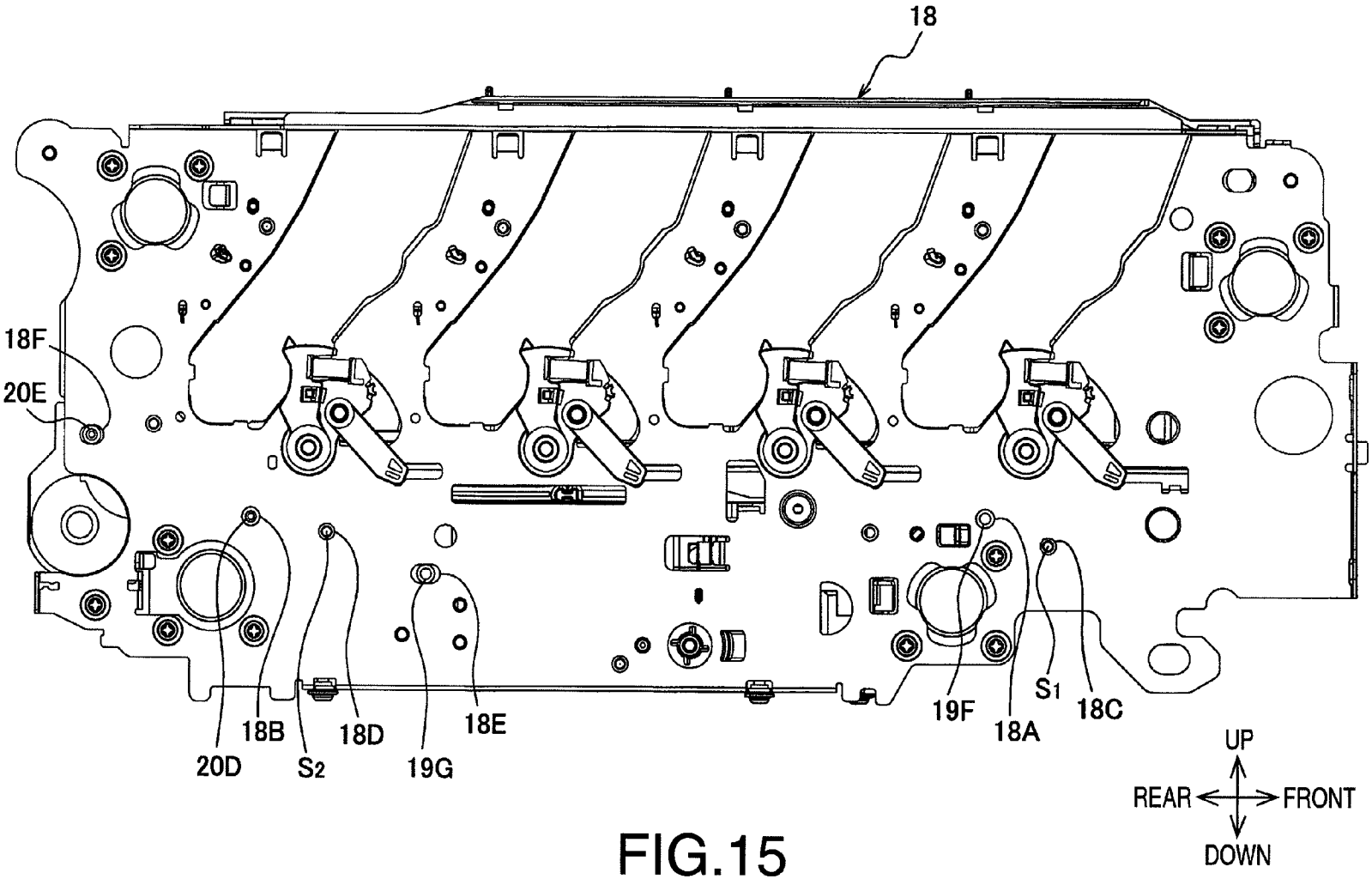
FIG. 15 is an outer side view of the metal frame of the printer according to the embodiment of the present invention.

As shown in FIG. 15, when the first resin frame 19 is attached to the metal frame 18, a first projection 19F formed in the first resin frame 19 is inserted to fit in the first positioning hole 18A of the metal frame 18. Thus, a center of the first positioning hole 18A, which is an original point for the first resin frame 19 with respect to the metal frame 18, and a center of the first projection 19F, which is an original point of the first resin frame 19, coincide, and the first resin frame 19 is set in the correct position with respect to the metal frame 18.

When the second resin frame 20 is attached to the metal frame 18, as shown in FIG. 15, a first projection 20D formed in the second resin frame 20 is inserted to fit in the first positioning hole 18B of the metal frame 18. Thus, a center of the first positioning hole 18B, which is an original point for the second resin frame 20 with respect to the metal frame 18, and a center of the first projection 20D, which is an original point of the second resin frame 20, coincide, and the second resin frame 20 is set in the correct position with respect to the metal frame 18.

It is preferable that fit tolerances of the first positioning hole 18A with the first projection 19F and the first positioning hole 18A with the first projection 20D are small enough to restrain joggles from occurring but to allow transition fit between the first resin frame 19 and the metal frame 18, and between the second resin frame 20 and the metal frame 18 respectively.

The fixing female screw hole 18C is a screw hole in which a screw S1 penetrating through the first resin frame 19 is inserted. Thus, the first resin frame 19 is fixed to the metal frame 18 by fastening power of the screw S1.

The fixing female screw hole 18D is a screw hole in which a screw S2 penetrating through the second resin frame 20 is inserted. Thus, the first resin frame second is fixed to the metal frame 18 by fastening power of the screw S2.

The second positioning hole 18E is an elongated round opening, by which the first resin frame 19 is set in a correct position with respect to the metal frame 18. The second positioning hole 18E restricts the first resin frame 19 from moving in a specific direction with respect to the metal frame but allows the first resin frame 19 to move in a direction perpendicular to the specific direction with respect to the metal frame 18. In the present embodiment, the specific direction refers to the vertical direction of the printer 1. The second positioning hole 18E has a longer axis and a shorter axis, and the longer axis extends in parallel with the direction (i.e., the front-rear direction) perpendicular to the specific direction.

The first resin frame 19 is formed to have a cylindrical projection 19G, which projects in the right-left direction of the printer 1. A diameter of the projection 19G substantially corresponds to a height (i.e., the shorter axis) of the second positioning hole 18E. In the present embodiment, when the projection 19G is set in the second positioning hole 18E, the first resin frame 19 is restricted from moving vertically by a cylindrical projection 19G penetrating through the second positioning hole 18E; therefore, the first resin frame 19 is prevented from rotating about the first positioning hole 18A. The first resin frame 19 is at the same time allowed to move in the front-rear direction of the printer 1, because the projection 19G is movable within the second positioning hole 18E.

The second positioning hole 18F is, similarly to the second positioning hole 18E, an elongated round opening with its longer axis extending in parallel with the front-rear direction of the printer 1. A cylindrical projection 20E formed in the second resin frame 20 is inserted to penetrate through the second positioning hole 18F when the second resin frame 20 is attached to the metal frame 18. Thus, the second resin frame 20 is restricted from moving vertically but allowed to move in the front-rear direction.

As shown in FIG. 7, the first resin frame 19 is formed to have pressing chips 19H, 19J, 19K, 19L, 19M, 19N, 19P, which protrude outward from outer edges of the first resin frame 19. The chips 19H, 19J, 19K, 19L, 19M, 19N, 19P are, when the first resin frame 19 is attached to the metal frame 18, pressed against the metal frame 18 by the flange portions 21A of the connecting frames 21 and the second resin frame 20 (see FIG. 16).

Figure 17A:
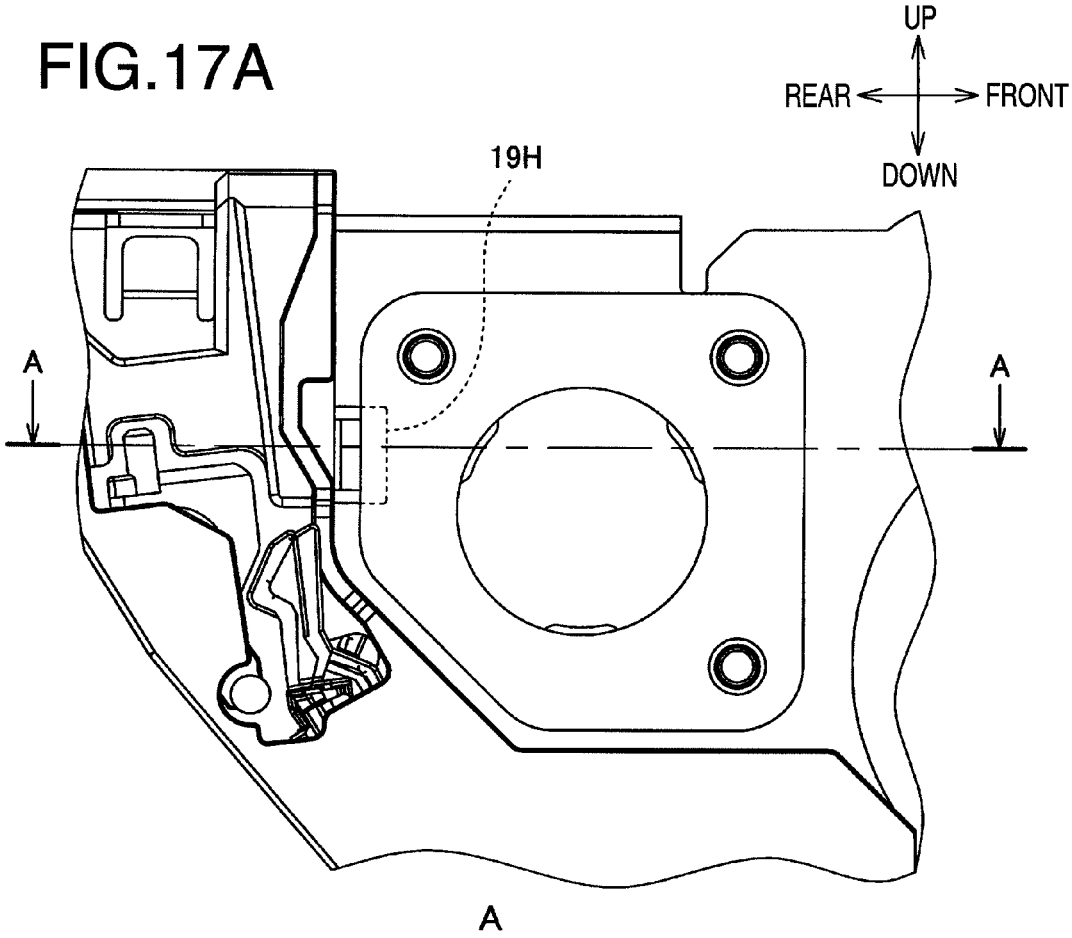
FIG. 17A is an enlarged view of an encircled portion A indicated in FIG. 16.
Figure 17B:
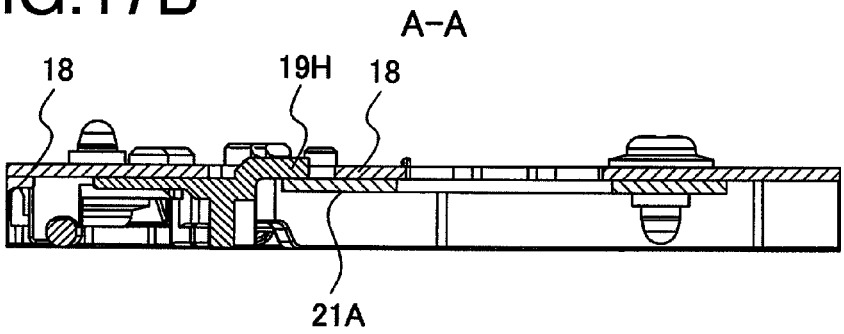
FIG. 17B is a cross-sectional view taken at a line A-A indicated in FIG. 17A.
Figure 18B:
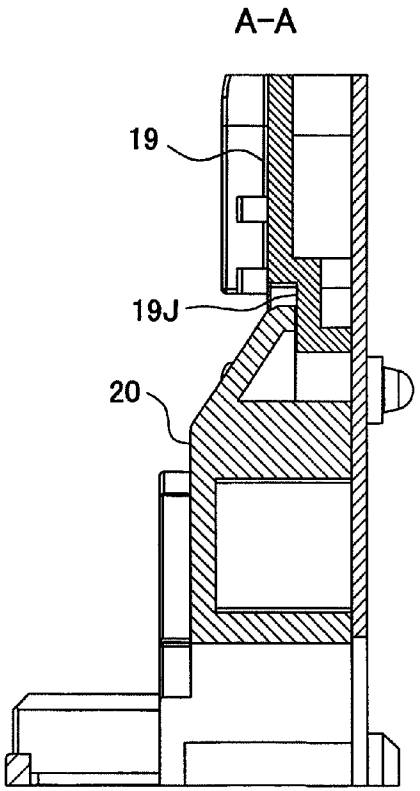
FIG. 18B is a cross-sectional view taken at a line A-A indicated in FIG. 18A.
Figure 18A:
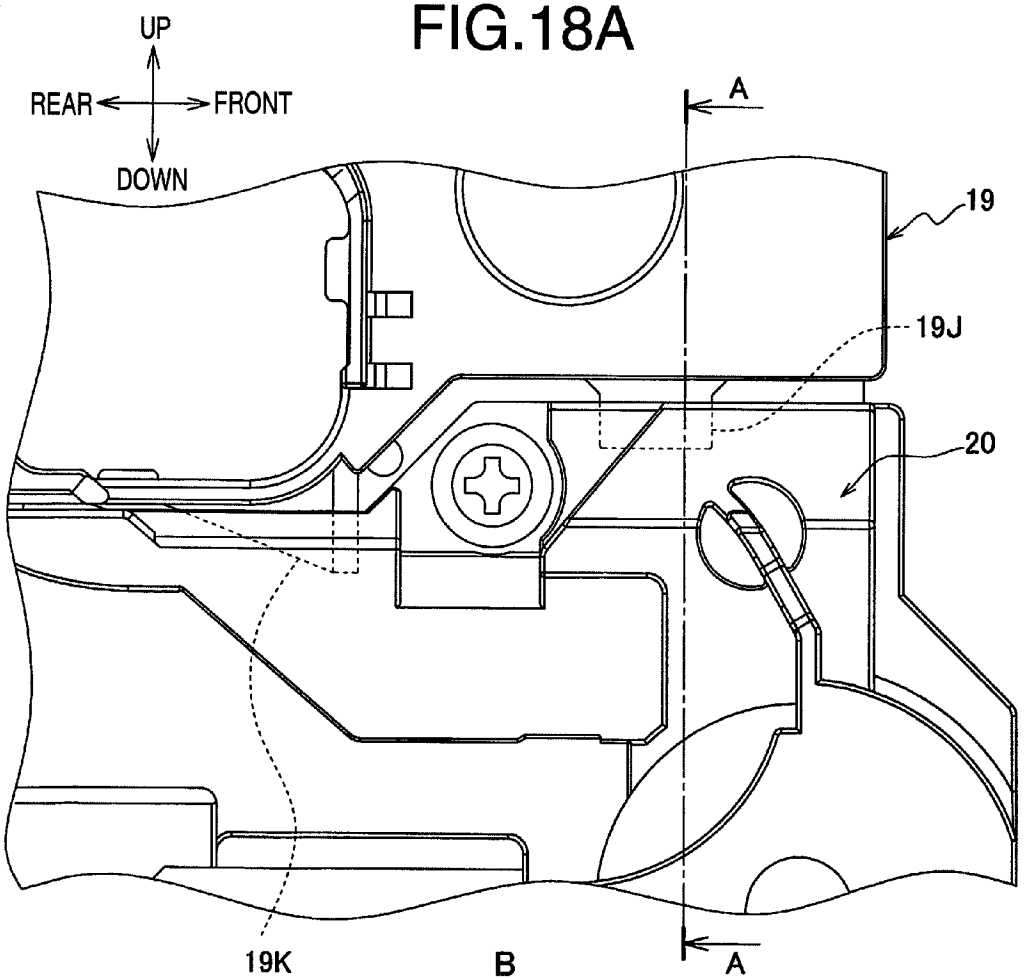
FIG. 18A is an enlarged view of an encircled portion B indicated in FIG. 16.

In particular, the flange portions 21A provided to lengthwise ends of the connecting frames 21 press the chips 19H, 19M, 19N against the metal frames 18 (see FIGS. 17A and 17B). Meanwhile, the second resin frames 20 press the chips 19J, 19K, 19L against the metal frames 18 (see FIGS. 18A and 18B).

As shown in FIG. 11, the second resin frame 20 is formed to have a chip 20F, which protrudes outward from an outer edge of the second resin frame 20. The chip 20F is, when the second resin frame 20 is attached to the metal frame 18, pressed against the metal frame 18 by the flange portion 21A of the connecting frames 21 (see FIG. 16).

The second resin frame 20 is pressed against the metal frame 18 by a screw 3S, which is provided in the vicinity of an outer edge of the second resin frame 20, in addition to the pressure received by the chip 20F.

Next, features of the frame assembly 16 in the printer 1 according to the present embodiment will be described. In the present embodiment, as has been described above, when the first resin frame 19 and the second resin frame 20 are attached to the metal frame 18, the first projection 19F of the first resin frame 19 is set in the first positioning hole 18A of the metal frame 18, and the first projection 20D of the second resin frame 20 is set in the first positioning hole 18B of the metal frame. Therefore, when the first resin frame 19 and/or the second resin frame 20 thermally expand or contract with respect to the metal frame 18, the first resin frame 19 and/or the second resin frame 20 tend to move with respect to the metal frame 18 originating from the centers of the first projection 19F and the first projection 20.

Meanwhile, the projection 19G of the first resin frame 19 is set in the second positioning hole 18E of the metal frame 18, and the projection 20E of the second resin frame 20 is set in the second positioning hole 18F of the metal frame 18. Therefore, the first resin frame 19 and the second resin frame 20 are restricted from moving in the vertical direction (i.e., the specific direction) of the printer 1 but allowed to move in the direction (front-rear direction) perpendicular to the vertical direction.

Further, the first resin frame 19 and the second resin frame 20 are not fixed to the metal frame 18 at the chips 19H, 19J, 19K, 19L, 19M, 19N, 19P and 20F but pressed against the metal frame 18 at the chips 19H, 19J, 19K, 19L, 19M, 19N, 19P and 20F; therefore, the first resin frame 19 and the second resin frame 20 are allowed to slide and to be displaced with respect to the metal frame 18.

The first resin frame 19 and the second resin frame 20 are, on the other hand, fixed to the metal frame 18 by the screw S1 and the screw S2 at the fixing female screw hole 18C and the fixing female screw hole 18D respectively. Therefore, when the first resin frame 19 and/or the second resin frame 20 thermally expand or contract with respect to the metal frame 18, a region in the first resin frame 19 between the first projection 19F corresponding to the first positioning hole 18A and the screw 1 corresponding to the fixing female screw hole 18C and a region in the second resin frame 20 between the first projection 20D corresponding to the first positioning hole 18B and the screw S2 corresponding to the fixing female screw hole 18D are likely to be subjected to the heat strain.

However, in the present embodiment, a length L1 between the first positioning hole 18A and the fixing female screw hole 18C is smaller than a length L2 between the first positioning hole 18A and the second positioning hole 18E, in which deformation of the first resin frame 19 is absorbed by the movement in the front-rear direction. Therefore, an amount of the heat strain occurring in the region in the L1 between the first projection 19F and the screw 1 can be suppressed to be smaller.

Similarly, a length L3 between the second positioning hole 18E and the fixing female screw hole 18D is smaller than a length L4 between the first positioning hole 18B and the second positioning hole 18F, in which deformation of the second resin frame 20 is absorbed by the movement in the front-rear direction. Therefore, an amount of the heat strain occurring in the region in the L3 between the first projection 20D and the screw 2 can be suppressed to be smaller.

According to the above configuration, when the length L1 between the first positioning hole 18A and the fixing female screw hole 18C is smaller than the length L2 between the first positioning hole 18A and the second positioning hole 18E, and the length L3 between the second positioning hole 18E and the fixing female screw hole 18D is smaller than the length L4 between the first positioning hole 18B and the second positioning hole 18F, substantial holding force to hold the first resin frame 19 and the second resin frame 20 on the metal frame 18 may not be achieved. Therefore, in order to achieve substantial force to retain the first resin frame 19 and the second resin frame 20 on the metal frame 18, the pressure to press the first resin frame 19 and the second resin frame 20 against the metal frame 18 at the chips 19H, 19J, 19K, 19L, 19M, 19N, 19P and 20F can be increased.

When the pressure to the chips 19H, 19J, 19K, 19L, 19M, 19N, 19P and 20F are increased, however, the first resin frame 19 and the second resin frame 20 may not be allowed to slide with respect to the metal frame 18 upon thermal expansion and contraction.

In the present embodiment, therefore, the chips 19H, 19J, 19K, 19L, 19M, 19N, 19P are arranged on the outer edges of the first resin frame 19 in positions outside with respect to any of positions of the first positioning hole 18A, the second positioning hole 18E, and the fixing female screw hole 18C. Thus, substantial lengths between the first projection 19F corresponding to the first positioning hole 18A and the chips 19H, 19J, 19K, 19L, 19M, 19N, 19P respectively can be secured. Therefore, the pressure to press the chips 19H, 19J, 19K, 19L, 19M, 19N, 19P against the metal frame 18 can be maintained small enough to allow the first resin frame 19 to slide with respect to the metal frame 18 whilst the first resin frame 19 can be securely attached to the metal frame 18.

Specifically, in the present embodiment, the chips 19H, 19J, 19K, 19L are formed in positions closer to the projection 19G corresponding to the second positioning hole 18E with respect to the first projection 19F corresponding to the first positioning hole 18A. Meanwhile, the lengths between the first projection 19F and the chips 19H, 19J, 19K, 19L respectively are greater than the length L1, which is between the first projection 19F corresponding to the first positioning hole 18A and the screw Si corresponding to the fixing female screw hole 18C. Therefore, the pressure to be applied at least to the chips 19H, 19J, 19K, 19L can be maintained small enough to allow the first resin frame 19 to slide with respect to the metal frame 18, whilst the substantial holding force to hold the first resin frame 19 on the metal frame 18 can be achieved.

The chip 20F of the second resin frame 20, similarly, is formed in a position outside any of positions of the first positioning hole 18B, the second positioning hole 18F, and the fixing female screw hole 18D. Thus, the chip 20F is arranged in a position closer to the position of the second correcting position 18F with respect to the first positioning hole 18B. Meanwhile, the length between the chip 20F and the first projection 20D corresponding to the first positioning hole 18B is greater than the length L3 between the first projection 20D corresponding to the first positioning hole 18B and the screw S2 corresponding to the fixing female screw hole 18D.

Thus, the length between the chip 20F and the first projection 20D corresponding to the first positioning hole 18B can be large enough to hold the second resin frame 20 on the metal frame 18. Therefore, the pressure to be applied to the chip 20D can be maintained small enough to allow the second resin frame 20 to slide with respect to the metal frame 18, whilst the substantial holding force to hold the second resin frame 20 on the metal frame 18 can be achieved.

As has been described above, according to the present embodiment, the first resin frames 19 and the second resin frames 20 can be attached securely on the metal frames 20 whilst distortion of the first resin frames 19 and the second resin frames 20 can be reduced. Therefore, the first resin frames 19 and the second resin frames 20 can be prevented from being exhausted by the distortion.

According to the above embodiment, the belt cleaner unit 15 is set in the correct position in the printer 1 by the cleaner positioning portions 19A formed in the first resin frames 19. Meanwhile, the belt unit 13 is set in the correct position in the printer 1 by the belt unit positioning portion 20A formed in the second resin frames 20. Thus, the belt cleaner unit 15 and the belt unit 13 are set in the positions defined by the positioning portions separately formed in the different resin frames respectively. Therefore, a rate of thermal expansion/contraction in dimensional variability of the first resin frame 19 and the second resin frame 20 in a portion between the cleaner positioning portion 19A and the belt unit positioning portion 20A becomes smaller with respect to a rate of thermal expansion/contraction of the metal frame 19. Thus, the thermal expansion/contraction rate of the metal frame 18 becomes greater.

Accordingly, in the present embodiment, the dimensional variability of the portion between the cleaner positioning portion 19A and the belt unit positioning portion 20A becomes substantially equivalent to dimensional variability of the portion between the original point 19F of the first resin frame 19 and the original point 20D of the second resin frame 20. In this regard, the dimensional variability of the portion between the original points 19F and 20D of the first resin frame 19 and the second resin frame 20 positioning the belt cleaner unit 15 and the belt unit 13 is substantially equivalent to dimensional variability of the portion of the metal frame 18 between the first positioning holes 18A and 18B. Therefore, the belt cleaner unit 15 and the belt unit 13 are held by the first resin frame 19 and the second resin frame 20 of which dimensional variability due to the thermal expansion/contraction is substantially equivalent to the dimensional variability of the metal frame 18.

In the present embodiment, thus, the dimensional variability of the cleaner positioning portion 19A and the belt unit positioning portion 20A can be smaller compared to dimensional variability in a frame assembly having a single pair of resin frames holding both of the belt cleaner unit 15 and the belt unit 13.

According to the present embodiment, the chips 19J, 19K, 19L are pressed by the second resin frame 20; therefore, additional members to press the chips 19J, 19K, 19L can be omitted so that a total number of components in the printer 1 can be reduced.

According to the present invention, the first resin frame 19 and the second resin frame 20 are set in positions to have the clearance 22 therebetween when the first resin frame 19 and the second resin frame 20 are attached to the metal frame 18. Therefore, one of the first resin frame 19 and the second resin frame 20 can be prevented from being affected by thermal expansion of the other of the first resin frame 19 and the second resin frame 20.

According to the present embodiment, the chips 19H, 19M, 19N, 19P, 20F are pressed against the metal frame by the flange portion 21A of the connecting frame 21; therefore additional members to press the chips 19H, 19M, 19N, 19P, 20F can be omitted so that a total number of components in the printer 1 can be reduced.

According to the present embodiment, the chips 19H, 19J, 19K, 19L, 19M, 19N, 19P, 20 are formed to protrude outward from outer edges of the first resin frame 19 or the second resin frame 20 so that the first resin frame 19 and the second resin frame 20 can receive the pressure against the metal frame 20 easily. Further, a number of assembling processes to assemble the frame assembly 16, and accordingly the printer 1, can be reduced.

According to the present embodiment, the printer 1 being a direct-tandem printer is required to have a length parallel to the rolling direction of the transfer belt 13A to be greater; therefore, the first resin frame 19 and the second resin frame 20 tend to expand in the direction parallel to the rolling direction of the transfer belt 13A. In the present embodiment, however, the dimensional variability of the portion between the cleaner positioning portion 19A and the belt unit positioning portion 20A is maintained small, and one of the first resin frame 19 and the second resin frame 20 is prevented from being affected by the thermal expansion of the other of the first resin frame 19 and the second resin frame 20. In consideration of the above, the present embodiment can be specifically effective when employed in a direct-tandem printer.

Although an example of carrying out the invention has been described, those skilled in the art will appreciate that there are numerous variations and permutations of the image forming apparatus that falls within the spirit and scope of the invention as set forth in the appended claims. It is to be understood that the subject matter defined in the appended claims is not necessarily limited to the specific features or act described above. Rather, the specific features and acts described above are disclosed as example forms of implementing the claims.

For example, in the above embodiment, positioning of the first resin frame 19 and the second resin frame 20 with respect to the metal frame 18 is achieved by the first positioning holes 18A, 18B and the second positioning holes 18E, 18F formed in the metal frames 18 and the first projections 19F, 20D, and the projections 19G, 20E formed in the first resin frame 19 and the second resin frame 20 respectively. Instead, the positioning projections may be formed in the metal frame 18 whilst the positioning holes are formed in the first and the second resin frames 19, 20.

For another example, in the above embodiment, the first resin frame 19 and the second resin frame 20 are fixed with respect to the metal frame 18 by fixture of the screws S1, S2 in the fixing female screw holes 18C, 18D. Instead, the first resin frame 19 and the second resin frame 20 can be fixed to the metal frame 18 by, for example, rivets and/or welding.

In the above embodiment, the chips 19H, 19J, 19K, 19L, 19M, 19N, 19P, 20E protruding outward from outer edges of the first resin frame 19 or the second resin frame 20 are formed to receive pressure toward the metal frame 18. However, the structures to receive the pressure are not limited to the chips protruding outward from outer edges of the first resin frame 19 or the second resin frame 20, but the first resin frame 19 and the second resin frame 20 may have different structures to receive the pressure.

In the above embodiment, the chips 19H, 19M, 19N, 19P, 20E protruding outward from outer edges of the first resin frame 19 or the second resin frame 20 are pressed against the metal frame 18 by the connecting frames 12. However, the structures to press the chips 19H, 19M, 19N, 19P, 20E are not limited to the connecting frames 21, but the chips may be pressed by different pressure applying structures.

In the above embodiment, the exposure units 9 having LEDs to emit light can be replaced with, for example, exposure units to emit laser beams which scan the surfaces of the photosensitive drums 7A.

The present invention is applied to a direct-tandem laser printer in the above embodiment, however, the present invention may be applied to, for example, a monochrome electrophotographic printer and an indirect transfer printer.

What is claimed is:

1. An image forming apparatus, comprising:

a plurality of detachable unit components; and a frame assembly to hold the detachable unit components in predetermined positions in the image forming apparatus, wherein the frame assembly includes:

a pair of metal frames; and a pair of resin frames, each of which is attached to one of the metal frames, wherein each of the metal frames includes:

a first positioning structure, which corresponds to an original point of the metal frame;

a first fixing structure;

a second positioning structure;

wherein each of the resin frames includes:

a first positioning structure, which corresponds to an original point of the resin frame;

a fixing structure;

a second positioning structure;

a plurality of pressing pieces, by which the resin frame is pressed against one of the metal frame;

wherein each of the resin frames is set in a predetermined position with respect to one of the metal frames by having the first positioning structure of the resin frame to coincide with the first positioning structure of the metal frame so that the original point of the resin frame coincides with the original point of the metal frame;

wherein each of the resin frames is fixed to one of the metal frame by having the fixing structure of the resin frame fixed to the fixing structure of the metal frame;

wherein each of the resin frames is restricted from moving in a specific direction and allowed to move in a different direction with respect to one of the metal frames by having the second positioning structure of the resin frame to coincide with the second positioning structure of the metal frame;

wherein a first length between the coinciding first positioning structures of the resin frame and the metal frame and the coinciding fixing structures of the resin frame and the metal frame is smaller than a second length between the coinciding first positioning structures of the resin frame and the metal frame and the coinciding second positioning structures of the resin frame and the metal frame; and wherein the plurality of pressing pieces are provided in positions outside closer to outer edges of the resin frame with respect to the first positioning structure and the fixing structure of the resin frame.

2. The image forming apparatus according to claim 1, wherein at least one of the pressing pieces is provided in a position closer to the second positioning structure with respect to the first positioning structure in the resin frame; and wherein a third length between the at least one pressing piece and the first positioning structure of the resin frame is greater than the first length.

3. The image forming apparatus according to claim 1,
wherein each of the resin frames includes first resin frame and a second resin frame;
wherein the first positioning structure, the fixing structure, and the second positioning structure in each resin frame include at least two first positioning portions, at least two fixing portions, and at least two second positioning portions respectively;
wherein each of the first resin frame and the second resin frame is provided with a unit-positioning portion to define a position of one of the unit components, one of the first positioning portions, one of the fixing portions, one of the second positioning portions, and one of the pressing pieces.

4. The image forming apparatus according to claim 3,
wherein at least one of the pressing pieces in one of the first resin frame and the second resin frame is pressed against the metal frame by the other of the first resin frame and the second resin frame.

5. The image forming apparatus according to claim 3,
wherein the first resin frame and the second resin frame are attached to the metal frame to have a predetermined amount of clearance therebetween.

6. The image forming apparatus according to claim 3, further comprising:
a belt unit, which has a belt having a tensioned surface and is rolled around a driving roller and a driven roller;
a belt cleaner unit configured to remove adhesive residues from the belt;
a plurality of photosensitive drums, which are aligned in line in a direction parallel with a rolling direction of the belt being rolled and in positions to oppose the tensioned surface of the belt;
wherein the belt unit is held by one of the first resin frame and the second resin frame;
wherein the belt cleaner unit is held by the other of the first resin frame and the second resin frame; and
wherein the first resin frame and the second resin frame are arranged side by side substantially in line in the aligning direction of the photosensitive drums with a predetermined amount of clearance therebetween.

7. The image forming apparatus according to claim 1,
wherein each of the metal frames is arranged on each widthwise end of the frame assembly;
wherein the frame assembly is provided with a plurality of connecting frames which connect the metal frames at the widthwise ends; and
wherein each of the resin frames is pressed against one of the metal frames at the pressing pieces by the connecting frames.

8. The image forming apparatus according to claim 1,
wherein plurality of pressing pieces are projections protruding outward from outer edges of the resin frames.

9. An image forming apparatus, comprising:
a plurality of detachable image forming units aligned in line along a direction;
a detachable belt unit, which is arranged to oppose the image forming units and includes a belt and belt frames, the belt having a surface to extend along the direction of the alignment of the image forming units and movable in the direction, and the belt frames holding the belt at each widthwise end of the belt, the widthwise ends of the belt being parallel to the moving direction of the belt; and
a frame assembly configured to hold the image forming units and the belt unit therein;
wherein the frame assembly includes:
a pair of side frames, each of which is disposed to oppose to the other on each widthwise side of the belt unit and has a plane to extend perpendicularly to the surface of the belt and in parallel with the moving direction of the belt; and
a plurality of connecting frames, which connect the opposing side frames,
wherein each of the side frames includes a plate-like metal frame and a pair of plate-like resin frames;
wherein the pair of resin frames are arranged to oppose to each other to hold the image forming units and the belt unit therebetween and are attached to the metal frames respectively to cover at least partially inner surfaces of the metal frames;
wherein each of the connecting frames is fixed to the inner surfaces of the metal frames at each end thereof; and
wherein the belt unit is detachably held by the opposing resin frames in a predetermined position in the opposing direction of the image forming units and the belt unit.

10. The image forming apparatus according to claim 9,
wherein the connecting frames are arranged in positions on outer side with respect to at least a part of the image forming units and the belt unit in the opposing direction of the image forming units and the belt unit and in positions on outer side with respect to at least one of the image forming units in the direction of the alignment of the image forming units.

11. The image forming apparatus according to claim 9,
wherein each of the resin frames is provided with a positioning portion to set the belt unit in the predetermined position;
wherein the belt frames are movable in the moving direction of the belt within the frame assembly to an extent;
wherein each of the belt frames is provided with a positioning portion and is restricted from moving beyond the predetermined position defined by the positioning portion of the resin frame when the positioning portion of the belt frame becomes in contact with the positioning portion of the resin frame.

12. The image forming apparatus according to claim 11,
wherein each of the resin frames is fixed to one of the metal frames at a fixing point, which is in the vicinity of the positioning portion of the resin frame, and is movable at remaining areas excluding the fixing point along the inner surface of the metal frame.

13. The image forming apparatus according to claim 12,
wherein each of the connecting frames is provided with a flange portion at each end thereof so that the connecting frame is fixed to the metal frame through the flange portion; and
wherein each of the resin frames is provided with a projection piece projecting outward from outer edges of the resin frame and being slidable on the inner surface of the metal frame when the remaining areas of the resin frame moves along the inner surface of the metal frame.

14. The image forming apparatus according to claim 9, further comprising:
a belt cleaner unit configured to remove adhesive residues from the belt;
wherein each of the pair of resin frames includes a first resin frame and a second resin frame, which are arranged side by side in a plane;
wherein the belt unit is held by the first resin frames and the second resin frames in the predetermined position in the opposing direction of the image forming units and the belt unit; and wherein the belt cleaner unit is held by the second resin frames in a predetermined position.

15. The image forming apparatus according to claim 9, wherein the belt frames are held by receiving portions formed in the resin frames to be in a predetermined position in the opposing direction of the image forming units and the belt unit so that the belt unit is set in the predetermined position in the opposing direction of the image forming units and the belt unit.

16. The image forming apparatus according to claim 15, wherein each of the metal frames is formed to have a plurality of guiding grooves, which are open-ended at an outer edge of the metal frame and detachably hold the image forming units;

wherein the receiving portion in one of the resin frames is formed on a plane protruding toward the other of the resin frames; and wherein the resin frames hold the belt frames laid on the receiving portions of the resin frames.

17. The image forming apparatus according to claim 16, wherein each of the resin frames is formed to have openings, which allow the image forming units to be held by the guiding grooves, in positions corresponding to the guiding grooves of the metal frame.

* * * * *